US010145044B2

(12) United States Patent
Schenk et al.

(10) Patent No.: US 10,145,044 B2
(45) Date of Patent: Dec. 4, 2018

(54) KNITTED BAG

(71) Applicant: adidas AG, Herzogenaurach (DE)

(72) Inventors: Stefan Schenk, Herzogenaurach (DE); Anika Ellerwald, Herzogenaurach (DE); Christine Korb, Herzogenaurach (DE); Louis Samuel Beck, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 102 days.

(21) Appl. No.: 15/093,106

(22) Filed: Apr. 7, 2016

(65) Prior Publication Data

US 2017/0022640 A1 Jan. 26, 2017

(30) Foreign Application Priority Data

Apr. 9, 2015 (DE) ..... 10 2015 206 301

(51) Int. Cl.

| | |
|---|---|
| ***A45C 3/00*** | (2006.01) |
| ***D04B 21/20*** | (2006.01) |
| ***A45F 3/04*** | (2006.01) |
| ***D04B 1/22*** | (2006.01) |
| ***A45F 3/02*** | (2006.01) |

(52) U.S. Cl.

CPC ..... *D04B 21/20* (2013.01); *A45C 3/00* (2013.01); *A45C 3/001* (2013.01); *A45F 3/02* (2013.01); *A45F 3/04* (2013.01); *D04B 1/22* (2013.01); *A45C 2003/002* (2013.01); *A45C 2003/007* (2013.01); *D10B 2501/061* (2013.01); *D10B 2505/10* (2013.01)

(58) Field of Classification Search

CPC ..... A45C 2200/10; A45C 3/001; A45C 3/00

USPC ..... 224/645, 647

See application file for complete search history.

(56) References Cited

U.S. PATENT DOCUMENTS

| | | | | |
|---|---|---|---|---|
| 167,563 A * | 9/1875 | Polle et al. | ..... | D04B 3/00 66/1 A |
| 459,866 A * | 9/1891 | Clewley | ..... | D04B 21/20 66/170 |
| 954,113 A | 4/1910 | Kraemer | | |
| 1,201,803 A * | 10/1916 | Chace | ..... | D04B 21/18 66/195 |

(Continued)

FOREIGN PATENT DOCUMENTS

| | | |
|---|---|---|
| AT | 62579 | 12/1913 |
| CN | 201557674 | 8/2010 |

(Continued)

OTHER PUBLICATIONS

German Patent Application No. 102015206301.1, First Office Action dated Jan. 20, 2016, 6 pages (No English translation available. A summary of the Office Action is provided in the Transmittal Letter submitted herewith.).

(Continued)

*Primary Examiner* — Brian D Nash

(74) *Attorney, Agent, or Firm* — Kilpatrick Townsend & Stockton LLP

(57) ABSTRACT

Described are bags having a sack-like body formed of knitwear. The knitwear includes a first layer and a second layer, wherein the first layer at least partly overlaps the second layer, and wherein the first layer and the second layer are knitted integrally in a one-piece knitting process.

21 Claims, 21 Drawing Sheets

(56) References Cited

U.S. PATENT DOCUMENTS 1,666,638 A * 4/1928 Bennett ..... D04B 27/26 66/195
2,263,787 A * 11/1941 Safferson ..... D04B 21/10 383/102
2,493,085 A * 1/1950 Pincus ..... A45C 3/045 383/127
2,552,443 A * 5/1951 Molinari ..... A45C 3/045 224/235
3,167,805 A * 2/1965 Zuppinger ..... A47K 5/04 401/201
3,331,221 A * 7/1967 Lawson, Jr. ..... D04B 21/12 206/0.5
3,483,907 A * 12/1969 Corridon ..... A45C 3/045 224/601
3,645,781 A * 2/1972 Brown ..... C07C 323/00 427/389
3,807,200 A * 4/1974 Liwski ..... D04B 1/22 66/170
4,015,443 A * 4/1977 Luchi ..... D04B 9/18 66/10
4,156,446 A * 5/1979 Nathan ..... A45C 3/00 383/103
4,196,534 A * 4/1980 Shibamoto ..... B65D 29/04 383/117
4,388,739 A * 6/1983 Martinon ..... D06F 95/006 383/102
4,785,613 A * 11/1988 Rhode ..... D04B 21/20 56/202
5,038,585 A * 8/1991 Robinson ..... D04B 1/108 66/170
5,692,660 A * 12/1997 Stewart ..... A45C 3/00 190/103
5,836,179 A * 11/1998 van Laar ..... D04B 1/243 66/171
5,855,231 A * 1/1999 Mintz ..... A22C 13/00 138/118
6,092,702 A * 7/2000 Cassidy, IV ..... A45C 7/0063 224/153
6,193,118 B1 * 2/2001 Kearl ..... A45C 7/0095 108/43
6,357,497 B1 * 3/2002 Frase ..... A45C 3/00 150/109
6,467,665 B1 * 10/2002 Jenkins ..... A45F 3/04 224/628
6,907,759 B2 * 6/2005 Sciacca ..... D04B 1/22 66/171
7,293,433 B1 * 11/2007 McMurray ..... D04B 21/10 66/170
8,173,558 B2 * 5/2012 Fukuoka ..... D04B 1/18 264/176.1
2004/0011085 A1 * 1/2004 Sciacca ..... D04B 1/22 66/8
2015/0259833 A1 * 9/2015 Lai ..... D04B 1/126 442/307

FOREIGN PATENT DOCUMENTS

| | | |
|---|---|---|
| CN | 103494401 | 1/2014 |
| CN | 104106874 | 10/2014 |
| CN | 203913743 | 11/2014 |
| DE | 10237307 | 5/2003 |
| DE | 102012206062 | 10/2013 |
| DE | 102013009003 | 12/2013 |
| DE | 102013207156 | 10/2014 |
| EP | 1916323 | 4/2008 |
| EP | 2149629 | 2/2010 |
| EP | 2584080 | 4/2013 |
| EP | 3001928 | 4/2016 |
| GB | 2304738 | 3/1997 |
| JP | 05790627 | 6/1982 |
| JP | 04118017 | 10/1992 |
| JP | 3406097 | 5/2003 |

OTHER PUBLICATIONS

European Patent Application No. 16161463.8, Extended European Search Report dated Sep. 13. 2016, 8 pages.
Chinese Application No. 201610214856.8, Office Action dated Aug. 21, 2017, 13 pages (7 pages for the original document and 6 pages for the English translation).
Japanese Patent Application No. 2016-076939, Office Action dated Aug. 28, 2018, 11 pages (6 pages for the original document and 5 pages for the English translation).

* cited by examiner

KNITTED BAG

CROSS REFERENCE TO RELATED APPLICATION

This application is related to and claims priority benefits from German Patent Application No. DE 10 2015 206 301.1, filed on Apr. 9, 2015, entitled Knitted bag ("the '301.1 application"). The '301.1 application is hereby incorporated herein in its entirety by this reference.

FIELD OF THE INVENTION

The present invention relates to a knitted bag and to a method of manufacturing said knitted bag.

BACKGROUND

Knitted bags for various uses and applications are known in the art. It is also known to knit said bags in one piece, either by hand or on a suitable knitting machine.

As used in this description, "knitting" includes both "weft-knitting" and "warp-knitting." Both knitting techniques are described in more detail in the context of some embodiments of the present invention.

The knitted bags known in the art have shortcomings, in that certain functions may be added only with considerable effort. For example, applying padding or cushioning zones to those knitted bags requires a number of additional manufacturing steps, such as manufacturing a lining member (for example cutting from a length of material), attaching (for example stitching) the lining member to the knitwear of the bag to obtain a recess, filling the recess with a padding material, and finally, closing the recess (for example stitching). Another example of a shortcoming is that providing the knitted bag with additional pockets requires additional manufacturing steps.

Those additional manufacturing steps are time-consuming and increase the manufacturing costs of said knitted bags. In addition, the aesthetical appearance of said knitted bags is considerably reduced by separate elements, which are attached to the knitwear by, for example, stitching, gluing or welding. While knitwear, in general, provides for a high-quality and sustainable appearance, these qualities are significantly reduced when additional elements are attached to the knitwear by, for example, gluing, stitching or welding.

It therefore is an object of the present invention to provide a knitted bag with additional functions, which may be manufactured quickly and cost-effectively, and has an appealing appearance.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a bag comprises a sack-like body comprising a knitwear, wherein the knitwear comprises a first layer and a second layer, wherein the first layer at least partly overlaps the second layer, and wherein the first layer and the second layer are knitted integrally in a one-piece knitting process.

In some embodiments, the bag has at least one handle. In certain embodiments, the handle, the first layer and the second layer are knitted integrally in the one-piece knitting process. The handle, in certain embodiments, is a tubular knitwear.

The first layer and the second layer, in some embodiments, form a tunnel in the knitwear, wherein the tunnel has a first opening and a second opening. In certain embodiments, a reinforcing webbing is arranged in the tunnel.

In certain embodiments, the first layer and the second layer form a pocket in the knitwear, and the pocket has an opening.

In some embodiments, a padding or a reinforcement is arranged between the first layer and the second layer.

The bag, in some embodiments, is a backpack.

In certain embodiments, the backpack has a first opening located at an upper side of the backpack and a second opening located at a lower side of the backpack, such that the backpack has a tube-like topology, when the first opening and the second opening are each open.

In some embodiments, the backpack has a closure member that extends from the first opening to the second opening.

The bag, in certain embodiments, has at least one shoulder strap. In some embodiments, the shoulder strap is knitted in one piece with the knitwear of the sack-like body. The shoulder strap, in certain embodiments, is manufactured separately from the sack-like body and attached to the sack-like body. In certain embodiments, the shoulder strap is a tubular knitwear.

In some embodiments, the sack-like body comprises at least one fusible yarn, which has been fused to reinforce the sack-like body.

The sack-like body, in some embodiments, has at least one area that is coated. In certain embodiments, the area is coated with a TPU coating.

In certain embodiments, the sack-like body comprises a pocket.

According to certain embodiments of the present invention, a method for manufacturing a bag comprises knitting a knitwear comprising a first layer and a second layer, wherein the first layer at least partly overlaps the second layer, and wherein the first layer and the second layer are knitted integrally in a one-piece knitting process, and forming a sack-like body using the knitwear.

According to some embodiments of the present invention, a bag comprises a sack-like body, wherein at least a portion of the sack-like body is formed of a knitwear comprising a first layer and a second layer, wherein the first layer at least partly overlaps the second layer, and wherein the first layer and the second layer are knitted integrally in a one-piece knitting process.

BRIEF DESCRIPTION OF THE DRAWINGS

In the following detailed description, embodiments of the invention are described referring to the following figures.

BRIEF DESCRIPTION

Figure 1A:
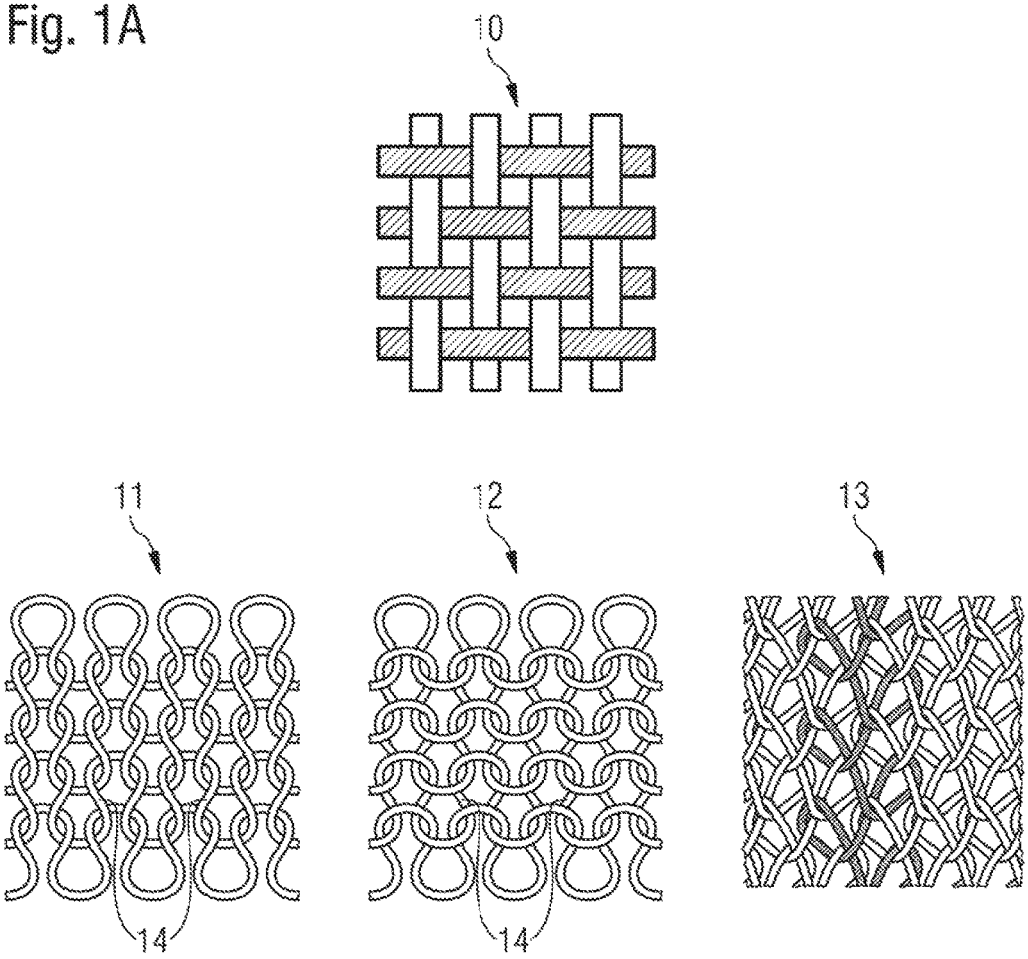
FIG. 1A is a schematic representation of textile structures, which may be used for certain embodiments of the present invention.

The present invention relates to a bag comprising a sack-like body, which comprises a knitwear being knitted in one piece, wherein the knitwear comprises a first layer and a second layer, wherein the first layer at least partly overlaps the second layer, and the first layer and the second layer are knitted integrally in a one-piece knitting process.

The sack-like body of the bag is understood as the part of the bag containing the items which are usually packed in the bag. The sack-like body of a backpack, for example, is the part of the bag which is usually worn on one's back, and provides a compartment for storing items. The sack-like body of a handbag, for example, is the part of the bag attached to the handles that provides a compartment for storing items.

As the knitwear of the bag, according to the invention, is knitted in one piece, the bag may be manufactured quickly and with little effort and low costs. A first layer and a second layer are integrated into the knitwear. The layers partly overlap, thereby forming a kind of tunnel or pocket. In this way, further functions may be easily provided. For example, the tunnel or pocket may be provided with cushioning or reinforcing inserts, or the pocket may be provided as a further compartment.

The first layer and the second layer are integral parts of the knitwear and are created during a single, one-piece knitting process within the knitwear. Thus, no further cost-intensive manufacturing steps are required to form the tunnel or pocket. Furthermore, the appearance of the bag is not impaired, as would be the case with separate elements (like pads) attached to the bag.

The bag may also have at least one handle. This allows the bag to be easily carried with a single hand.

The handle may be knitted in one piece with the knitwear of the sack-like body. This omits additional manufacturing steps of producing the handle and attaching it to the bag, and reduces additional efforts and costs for providing the handle.

The handle may comprise tubular knitwear. Tubular knitwear allows for easy padding or cushioning because a corresponding insert may be placed in a void formed by the tubular knitwear.

The first layer and the second layer may form a tunnel in the knitwear having a first opening and a second opening. The tunnel may provide padding or reinforcement by inserting a corresponding insert into the tunnel. For example, the bag may have a reinforcing webbing, plastic or metal member, air bladder, or foamed material arranged in the tunnel as the corresponding insert. Such padding or reinforcement may, for example, be arranged at the side of a backpack and facing a person's back, to provide cushioning and/or reinforcement.

The first layer and the second layer may form a pocket in the knitwear, and the pocket may have one opening. The pocket may either be arranged inside or outside the sack-like body. The pocket may be used as a further compartment for storing. Alternatively, the pocket may receive an insert, for example, an insert for cushioning or reinforcement. The bag may have more than one pocket or no pocket at all.

An insert providing padding or reinforcement may be arranged between the first layer and the second layer. In this way, the bag may be provided easily with additional functionality with a minimum number of additional manufacturing steps.

The bag may be a backpack. Backpacks are beneficial for carrying heavy loads, such as mountaineering equipment.

The backpack may have a first opening located at the upper side of the backpack and a second opening located at the lower side of the backpack, such that the backpack has a tube-like topology when the first opening and the second opening are each open. This topology allows easy access to the interior of the backpack from the two sides. Thus, objects at the bottom of backpack may be accessed easily, without the need to empty the backpack from above, as would be the case with conventional backpacks.

The backpack may have a closure member extending from the first opening to the second opening. If the closure member is opened, the interior of the backpack is easily accessible, and the backpack may be filled and emptied quickly. The closure member may be, for example, a zipper, a snap button, a magnet, or a hook-and-loop fastener.

The backpack may have at least one shoulder strap. The shoulder strap may be knitted in one piece with the knitwear of the sack-like body. Thus, the backpack may be equipped with at least one shoulder strap with only a minimal number of additional manufacturing steps. In addition, the one-piece look of the backpack provides for an appealing appearance.

Alternatively, the shoulder strap may be manufactured separately from the sack-like body, and may be attached to the sack-like body.

The shoulder strap may comprise tubular knitwear. Tubular knitwear allows for easy padding or cushioning by placing a corresponding insert in a void formed by the tubular knitwear.

The sack-like body may have at least one fusible yarn, which has been fused to reinforce the sack-like body. Thus, the knitwear may be provided with a reinforcement with only a limited number of additional steps. In particular, the fusible yarns may be incorporated into the knitwear during the one-piece knitting process.

The body may have at least one area which is coated. The coating may, for example, provide water-repellency or abrasion-resistance.

The area may be coated with a TPU coating. TPU is easy to handle and to apply.

Alternatively, or additionally, the area may be coated with UV glue. UV glue may be applied in liquid form, and cures under UV light by a photochemical process. Other coatings may be used as well.

The knitwear may have at least one area with a fusible yarn. Fusible yarns melt when heated above the melting temperature and stiffen when cooling below the melting temperature. Stiffened fusible yarns may provide water-repellency, abrasion-resistance and reinforcement to the knitwear at targeted areas.

The sack-like body may have a pocket, which provides a further compartment for storage. The pocket may be attached to the bag, for example, by knitting, stitching, gluing, snapping, welding, or a hook-and-loop fastener.

The present invention additionally relates to a method for manufacturing a bag, comprising the steps of knitting knitwear in one piece, such that the knitwear comprises a first layer and a second layer, wherein the first layer at least partly overlaps the second layer, and wherein the first layer and the second layer are knitted integrally in a one-piece knitting process; and using the knitwear to provide a sack-like body comprising the knitwear.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments and variations of the present invention will be described in more detail in this section. These descriptions are for both a knitted bag, according to certain embodiments of the present invention, as well as a method of manufacturing said bag. The manufacturing and treatment of knitwear in the context of the present invention will be described first, followed by a description of some embodiments of knitted bags according to the invention.

The use of knitwear allows products, such as a knitted bag according to the present invention, to be equipped with areas having different characteristics that provide different functions, with low production effort. These characteristics include bendability, stretchability (expressed as Young's modulus, for example), permeability to air/breathability and water, thermoconductivity, thermal capacity, moisture absorption, static friction, abrasion resistance, reinforcement, hardness, and thickness, for example. Permeability to air and breathability may, for example, be achieved by knitting a more open mesh- or web-like structure.

Various techniques are applied to achieve such characteristics or functions. These techniques include suitable techniques in manufacturing knitwear, such as knitting techniques, the selection of fibers and yarns, coating the fibers, yarns or knitwear with polymer or other materials, the use of monofilaments, the combination of monofilaments and polymer coating, the application of fusible/melted yarns, and multi-layer textile material. In general, the yarns used for the manufacture of knitwear may be equipped (coated accordingly). In addition, or alternatively, the finished knitwear may be equipped accordingly.

Another aspect of providing different functions is the specific use of knitwear for certain areas of a product, for example, for a shoe upper or a sole, and the connection of different parts by suitable connection techniques. The mentioned aspects and techniques, as well as other aspects and techniques, will be explained in the following description. The suitable connection techniques may be used individually, or may be combined in any manner in the context of the present invention Knitwear Knitwear used in the present invention is divided into weft-knitted fabrics and single-thread warp-knitted fabrics on the one hand, and warp-knitted fabrics on the other hand. A distinctive characteristic of knitwear is that it is formed of interlocking yarn or thread loops. These thread loops are also referred to as stitches, and may be formed of one or several yarns or threads.

Yarn and thread are terms for a structure of one or several fibers that is long in relation to its diameter. A fiber is a flexible structure that is rather thin in relation to its length. Very long fibers, of virtually unlimited length with regard to their use, are referred to as filaments. Monofilaments are yarns consisting of one single filament, that is, one single fiber.

In weft-knitted fabrics and single-thread warp-knitted fabrics, the stitch formation requires at least one thread or yarn, with the thread running in a longitudinal direction of the product (at a right angle to the direction in which the product is made during the manufacturing process). In warp-knitted fabrics, the stitch formation requires at least one warp sheet (a plurality of so-called warps), which the stitch-forming threads running in a longitudinal direction (in the direction in which the product is made during the manufacturing process).

FIG. 1A shows some differences between woven fabrics 10, weft-knitted fabrics 11 and 12 and warp-knitted fabric 13. A woven fabric 10 has at least two thread sheets, which are usually arranged at a right angle to one another. The threads are placed above or underneath each other and do not form stitches. Weft-knitted fabrics 11 and 12 are created by knitting one thread from the left to the right using interlocking stitches. View 11 shows a front view (also referred to as the front loop fabric side) and view 12 shows a back view (also referred to as the back loop fabric side) of a weft-knitted fabric. The front loop and back loop product sides differ in the run of legs 14. The legs 14 are covered on the back loop fabric side 12, but not on the front loop fabric side 11.

Figure 1B:
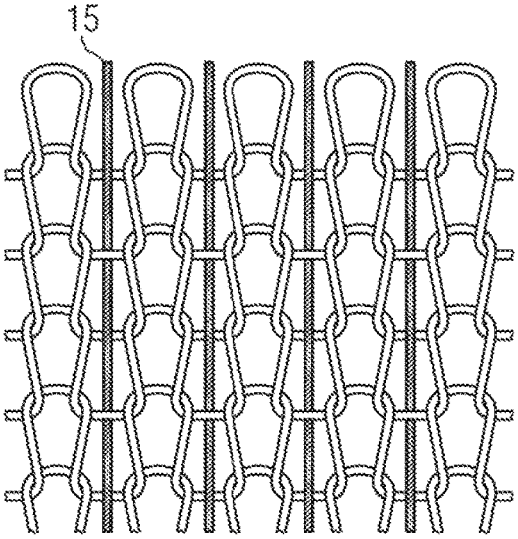
FIG. 1B is a schematic representation of a weft-knitted fabric with a filler yarn, which may be used for some embodiments of the present invention.

Another weft-knitted fabric, which may be used for the present invention with a so-called filler yarn 15, is shown in FIG. 1B. The filler yarn 15 is a length of a thread placed between two wales in a longitudinal direction, and is held by transverse threads of other weave elements. Combining the filler yarn 15 with other weave elements influences the properties of the weft-knitted fabric or achieves various pattern effects. Stretchability of the weft-knitted fabric in the direction of the wales may, for example, be reduced by the filler yarn 15.

Warp-knitted fabric 13 is created by warp-knitting with many threads from the top down, as shown in FIG. 1A. In doing so, the stitches of a thread are interlocked with the stitches of neighboring threads. Depending on the pattern according to which the stitches of the neighboring threads are interlocked, one of the seven basic connections (also referred to as "interlaces" in warp-knitting) pillar, tricot, 2×1 plain, satin, velvet, atlas and twill are created.

Figure 2:
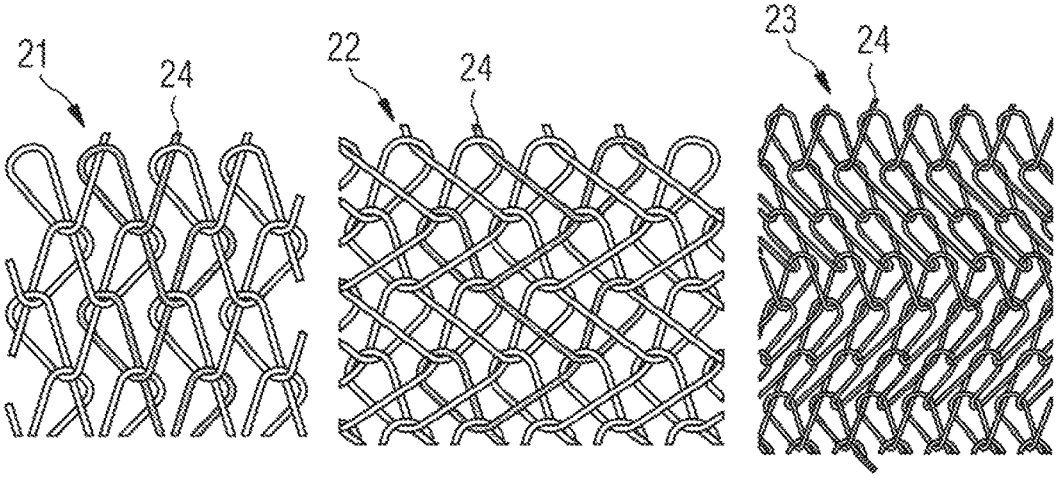
FIG. 2 shows three different interlaces of a warp-knitted fabric, which may be used for certain embodiments of the present invention.

An interlaces tricot 21, a 2×1 plain 22 and an atlas 23 are shown in FIG. 2. A different interlocking results depending on how the stitches of thread 24, which is highlighted as an example, are interlocked in the stitches of neighboring threads. In the tricot interlace 21, the stitch-forming thread zigzags through the knitwear in a longitudinal direction and binds between two neighboring wales. The 2×1 plain interlace 22 binds in a manner similar to that of the tricot interlace 21, but each stitch-forming warp skips a wale. In the atlas interlace 23, each stitch-forming warp runs to a turning point in a stair-shape, and then changes direction.

Figure 3:
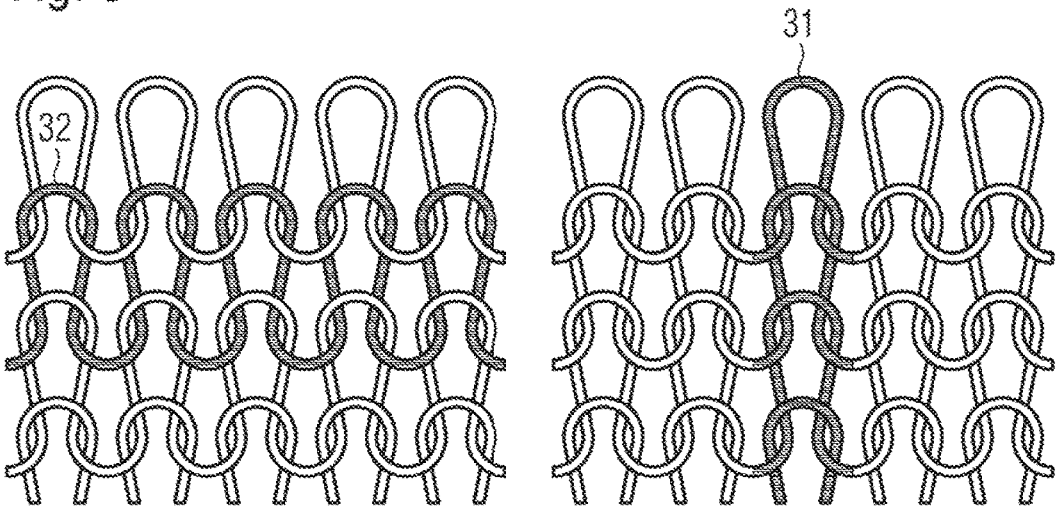
FIG. 3 shows course and wale of a weft-knitted fabric, which may be used for some embodiments of the present invention.

Stitches arranged above each other with joint binding sites are referred to as wales. FIG. 3 shows a wale, as an example of a weft-knitted fabric, with reference number 31. The term wale is also used analogously in warp-knitted fabrics. Wales run vertically through mesh fabric. Rows of stitches arranged next to one another, shown by way of example for a weft-knitted fabric with reference number 32 in FIG. 3, are referred to as courses. The term course is also used analogously in warp-knitted fabrics. Accordingly, courses run through mesh fabric in a lateral direction.

Figure 4:
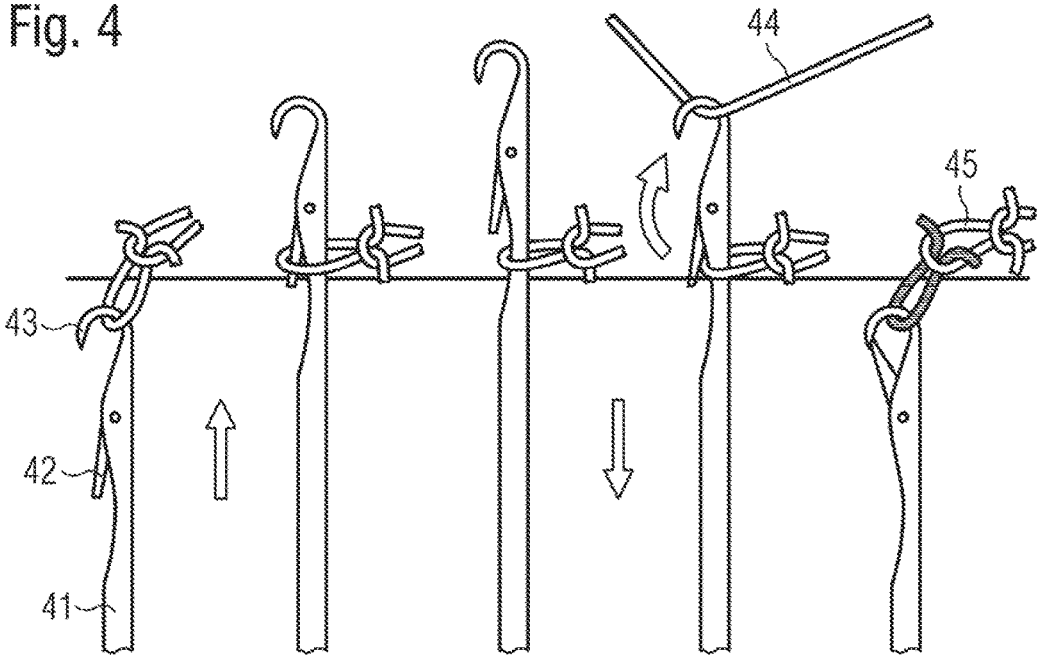
FIG. 4 shows stitch forming by latch needles during weft-knitting.

Three basic weft-knitted structures are known in weft-knitted fabrics, and may be recognized by the run of the stitches along a wale. With plain, single Jersey, only back loops may be recognized along a wale on one side of the fabric, and only back loops may be recognized along the other side of the fabric. This structure is created on one row of needles of a knitting machine (an arrangement of neighboring knitting needles), and is referred to as single Jersey. With rib fabric, front and back loops alternate within a course, so either front or back loops may be found along a wale, depending on the side of the fabric from which the wale is considered. This structure is created on two rows of needles with needles offset opposite each other. With purl fabric, front and back loops alternate in one wale, so both sides of the fabric look the same. This structure is manufactured using latch needles, as illustrated in FIG. 4, by stitch transfer. Stitch transfer may be avoided if double latch needles are used, which comprise both a hook and a latch at each end.

An essential advantage of knitwear over woven textiles is that knitwear may be created with a variety of structures and surfaces. Both very heavy and/or stiff knitwear and very soft, transparent and/or stretchable knitwear may be manufactured with essentially the same manufacturing technique. Properties of the material may be influenced by the pattern of weft-knitting or warp-knitting, the yarn used, the needle size or the needle distance, and the tensile strain, which is subject to how the yarn is placed on the needles.

A benefit of weft-knitting is that certain yarns may be weft-knitted in at freely selectable places. In this manner, selected zones may be provided with certain properties. For example, the sack-like bag according to some embodiments of the invention may be provided with zones made from rubberized yarn in order to achieve higher friction. By certain yarns being weft-knitted in at selected places, no additional elements, like patches for reinforcement, have to be applied.

Knitted fabrics are manufactured on machines in the industrial context. These machines usually comprise a plurality of needles. In weft-knitting, latch needles 41 are usually used, each of which comprise a moveable latch 42, as illustrated in FIG. 4. This latch 42 closes a hook 43 of the needle 41 such that a thread 44 may be pulled through a stitch 45 without the needle 41 being caught on the stitch 45. In weft-knitting, the latch needles 41 are usually moveable individually, so that every single latch needle may be controlled such that it catches a thread for stitch formation.

A difference between flat-knitting and circular-knitting machines is that in flat-knitting machines, a thread feeder feeds the thread back and forth along a row of needles, while in circular-knitting machines, the needles are arranged in a circular manner, and the thread feeding takes place in a circular movement along at least one circular row of needles.

Instead of a single row of needles, a knitting machine may have two parallel rows of needles. When looked at from the side, the needles of the two rows of needles may, for example, be opposite each other at a right angle. This enables the manufacture of more elaborate structures or weaves. The use of two rows of needles allows the manufacture of a one-layered or two-layered weft-knitted fabric. A one-layered weft-knitted fabric is created when stitches generated on the first row of needles are enmeshed with stitches generated on the second row of needles.

A two-layered weft-knitted fabric, like the one according to some embodiments of the invention, is created when stitches generated on the first row of needles are not, or are only selectively enmeshed with stitches generated on the second row of needles and/or if stitches generated on the first row of needles are merely enmeshed at an end of a tow-layered weft-knitted fabric. If stitches generated on the first row of needles are loosely enmeshed only selectively with stitches generated on the second row of needles by an additional yarn, this is referred to as spacer weft-knitted fabric. The additional yarn, for example a monofilament, is guided back and forth between the two layers, so that a distance between the two layers is created. The two layers may be connected to each other via a so-called handle stitch.

The following weft-knitted fabrics may be manufactured on a weft-knitting machine. If only one row of needles is used, a one-layered weft-knitted fabric is created. If two rows of needles are used, stitches of both rows of needles may be connected consistently to each other so that a resulting knitwear comprises a single layer. If two rows of needles are used, and stitches of both rows of needles are not connected, or are only connected along certain lines, two layers are created, for example, to form a first layer and second layer in a knitwear. If two rows of needles are used, and stitches of both rows of needles are only connected at an edge of the knitwear, a resulting knitwear is called a tubular knit. If two rows of needles are used, and stitches of both rows of needles are connected selectively, in turn, by an additional thread, a spacer weft-knitted fabric is created. The additional thread is also referred to as spacer thread, and it may be fed via a separate yarn feeder.

Single-thread warp-knitted fabrics are manufactured by jointly moved needles. Alternatively, the needles are fixed and the fabric is moved. In contrast to weft-knitting, the needles may not be moved individually. Similarly to weft-knitting, there are flat single thread warp-knitting and circular single thread warp-knitting machines.

In warp-knitting, one or several coiled threads, which are positioned next to one another, are used. In stitch formation, individual warps are placed around the needles and the needles are moved jointly.

The techniques described herein, as well as further aspects of the manufacture of knitwear, may be found in "*Fachwissen Bekleidung*", 6$^{th}$ ed. by H. Eberle et al. (published with the title "*Clothing Technology*" in English), in "*Textil- und Modelexikon*", 6$^{th}$ ed. by Alfons Hofer and in "*Maschenlexikon*", 11$^{th}$ ed. by Walter Holthaus, for example.

Three-dimensional Knitwear

Three-dimensional (3D) knitwear may also be manufactured on weft-knitting machines and warp-knitting machines. Three-dimensional knitwear is knitwear that has a spatial structure although it is weft-knitted or warp-knitted in a single process.

A three-dimensional weft-knitting or warp-knitting technique allows for spatial knitwear to be manufactured in a single process and without seams, cutting, or making-up into one piece.

Three-dimensional knitwear may, for example, be manufactured by varying the number of stitches in the direction of the wales, by forming partial courses. The corresponding mechanical process is referred to as "needle parking." Depending on the requirement, this process may be combined with structural variations and/or variations of the number of stitches in the direction of the course. When partial courses are formed, stitch formation temporarily occurs along only a partial width of the weft-knitted fabric or warp-knitted fabric. The needles that are not involved in the stitch formation keep the half-finished stitches ("needle parking") until weft-knitting occurs again at this position. In this way, bulges, for example, may be achieved.

By three-dimensional weft-knitting or warp-knitting a sack-like bag according to certain embodiments of the invention, a three dimensional shape may be obtained. Contours, structures, knobs, curvatures, notches, openings, fasteners, loops and pockets may be integrated into the knitwear in a single process. Three-dimensional knitwear may be used for the present invention in a desirable manner.

Functional Knitwear

Knitwear and particularly weft-knitted fabric may be provided with a range of functional properties and be used in the present invention in a desirable manner.

It is possible to utilize a weft-knitting technique to manufacture knitwear that has different functional areas while maintaining its contours. The structures of knitwear may be adjusted to provide functional requirements in certain areas by the stitch pattern, the yarn, the needle size, the needle distance, or the tensile strain, which is subject to the yarn that is placed on the needles being selected accordingly.

Knitwear with more than one layer, for example, two layers, may be weft-knitted or warp-knitted on a weft-knitting machine or a warp-knitting machine with several rows of needles, for example, two rows, in a single stage, as described above in the section "Knitwear." Alternatively, several layers, for example, two layers, may be weft-knitted or warp-knitted in separate stages and then placed above each other and connected to each other, if applicable, such as by stitching, gluing, welding or linking.

Several layers increase solidness and stability of the knitwear. In this regard, the resulting solidness depends on the extent to which, and the techniques by which the layers are connected to each other. The same yarn or different yarns may be used for the individual layers. For example, one layer may be weft-knitted from multi-fiber yarn, and one layer may be weft-knitted from monofilament, whose stitches are enmeshed, in a weft-knitted fabric. Stretchability of the weft-knitted layer is reduced due to this combination of different yarns. It is a beneficial alternative of this construction to arrange a layer made from monofilament between two layers made from multi-fiber yarn to reduce stretchability and increase solidness of the knitwear. This results in a pleasant surface made from multi-fiber yarn on both sides of the knitwear.

An alternative to two-layered knitwear is referred to as spacer weft-knitted fabric or spacer warp-knitted fabric, as explained above in the section "Knitwear." In this regard, a spacer yarn is weft-knitted or warp-knitted, more or less, loosely between two weft-knitted or warp-knitted layers, interconnecting the two layers, and simultaneously serving as a filler. The spacer yarn may be the same material as the layers themselves, for example, polyester or another material. The spacer yarn may also be a monofilament, which provides the spacer weft-knitted fabric or spacer warp-knitted fabric with stability.

Such spacer weft-knitted fabrics or spacer warp-knitted fabrics, which are also referred to as three-dimensional weft-knitted fabrics, but are different from the formative 3D weft-knitted fabrics or 3D warp-knitted fabrics mentioned in the section "Three-dimensional knitwear" above, may be used wherever additional cushioning or protection is desired, for example, at the bottom of the bag, according to the invention, which regularly has contact with the ground.

Multi-layered constructions also provide opportunities for color design, by different colors being used for different layers. For example, knitwear may be provided with two different colors for the front and the back. A bag made from such knitwear may then have a different color on the outside than on the inside.

An alternative to multi-layered constructions are pockets or tunnels, in which two textile layers, or knitwear weft-knitted or warp-knitted on two rows of needles, are connected to each other only in certain areas so that a hollow space is created. For example, to provide additional pockets, items of knitwear weft-knitted or warp-knitted in two separate processes are connected to each other by, for example, stitching, gluing, welding or linking, so that a void is created. In both cases, it is then possible to introduce a cushioning material such as a foam material (e.g. EVA, etc.), eTPU (expanded thermoplastic urethane), ePP (expanded polypropylene), expanded EVA (ethylene vinyl acetate) or particle foam, an air or gel cushion (e.g. via a bladder) into the void, through an opening. Alternatively, or additionally, the pocket may be filled with a filler thread or a spacer knitwear. It is also possible for threads to be pulled through tunnels, for example, as reinforcement in case of tension loads in certain areas of the bag. Moreover, it is also possible for cords to be guided through such tunnels. Loose threads may also be placed into tunnels or pockets for padding. However, it is also possible for stiffer reinforcing elements, such as caps, flaps or bones to be inserted into tunnels or pockets. These stiffer reinforcing elements may be manufactured from plastic such as polyethylene, TPU, polyethylene or polypropylene, for example.

A further possibility for a functional design of knitwear is the use of certain variations of basic weaves. In weft-knitting, it is possible for bulges, ribs or waves to be weft-knitted in certain areas, for example, in order to achieve reinforcement in those areas. A wave may, for example, be created by stitch accumulation on a layer of knitwear. This means that more stitches are weft-knitted or warp-knitted on one layer than on another layer. Alternatively, different stitches are weft-knitted on the one layer than on the other layer, for example, by being weft-knitted tighter or wider, or by using a different yarn. Thickening results by using both of these variations.

Ribs, waves or similar patterns may, for example, also be used at the bottom of a bag according to the invention in order to provide a "tread" and to provide the bag with non-slip properties, for example, for a backpack for mountaineering. In order to obtain a rather thick weft-knitted fabric, for example, it is possible to use the weft-knitting techniques, such as "tuck" or "half cardigan," which are described in "*Fachwissen Bekleidung,*" 6th ed. by H. Eberle et al., for example.

Waves may be weft-knitted or warp-knitted such that a connection is created between two layers of a two-layered knitwear, or such that no connection is created between the two layers. A wave may also be weft-knitted as a right-left wave on both sides with or without a connection of the two layers. A structure in the knitwear may be achieved by an uneven ratio of stitches on the front or the back of the knitwear.

A further possibility of functionally designing knitwear within the framework of the present invention is providing openings in the knitwear during weft-knitting or warp-knitting.

Another possibility of functionally designing knitwear within the framework of the present invention is forming at least one cord integrally with the knitwear of the bag. Such a cord may be used, for example, to close an opening in the bag. In some embodiments, the cord is warp-knitted or weft-knitted integrally with the knitwear, for example, when the knitwear of the shoe upper according to the invention is weft-knitted or warp-knitted. In this regard, a first end of the cord may be connected to the knitwear, while a second end is free.

The knitwear is particularly stretchable in the direction of the stitches (longitudinal direction) due to its construction. This stretching may be reduced, for example, by subsequent polymer coating of the knitwear, which will be described below. The stretching may also be reduced during manufacture of the knitwear itself, for example, by reducing the mesh openings, that is, using a smaller needle size. Smaller stitches generally result in less stretching of the knitwear. The stretching of the knitwear may be reduced by knitted reinforcement, such as three-dimensional structures. Said structures may be arranged on the inside or the outside of the knitwear of the bag. Furthermore, non-stretchable yarn, such as yarn made from nylon, may be laid in a tunnel along the knitwear in order to limit stretching to the length of the non-stretchable yarn.

Colored areas with several colors may be created by using a different thread and/or by additional layers. In transitional areas, smaller mesh openings (smaller needle sizes) are used in order to achieve a fluent passage of colors.

Further effects may be achieved by weft-knitted insets (inlaid works) or Jacquard knitting. Inlaid works are areas which only provide a certain yarn, for example, in a certain color. Neighboring areas, which may comprise a different yarn, for example, in a different color, are then connected to each other by a so-called handle.

During Jacquard knitting, two rows of needles may be used, and two different yarns may run through all areas. However, in certain areas only one yarn appears on the visible side of the knitwear and the other yarn runs invisibly on the other side of the knitwear.

The bag according to the invention may be manufactured from the knitwear as a whole, or it may be put together from different parts of knitted goods. A whole bag or parts of a bag may, for example, be separated, such as punched from a larger piece of knitwear. The larger piece of knitwear may, for example, be a circular weft-knitted fabric, a circular warp-knitted fabric, a flat weft-knitted fabric, or a flat warp-knitted fabric.

Applications such as polyurethane (PU) prints, thermoplastic polyurethane (TPU) ribbons, textile reinforcements, leather, and rubber may be applied to the knitwear of the bag. Thus, it is possible, for example, to apply a plastic cap as reinforcement, a logo, an eyelet for a cord, or a zipper on the bag, for example, by stitching, gluing, snap button or welding, as described below.

Stitching, gluing or welding, for example, are suitable connection techniques for connecting individual parts of a knitwear with other textiles or with other parts of the knitwear. Linking is another suitable connection technique for connecting two parts of a knitwear, whereby, two edges of the knitwear are connected to each other according to the stitches (usually stitch by stitch).

A possibility for welding textiles, particularly textiles made from plastic yarns or threads, is ultrasonic welding. Therein, mechanical oscillations in the ultrasonic frequency range are transferred to a tool referred to as a sonotrode. The oscillations are transferred to the textiles to be connected by the sonotrode under pressure. Due to the resulting friction, the textiles are heated up, softened, and ultimately connected at an area where the textile makes contact with the sonotrode. Ultrasonic welding allows rapid and cost-effective connecting, particularly of textiles with plastic yarns or threads. It is possible for a ribbon to be attached, for example glued, to the weld seam, which additionally reinforces the weld seam and is optically more appealing.

The use of adhesive tape is another suitable connection technique for connecting textile areas. This may also be used in addition to an existing connection, for example, over a stitched seam or a welded seam. Adhesive tape may provide additional functions, such as protection against dirt or water. Adhesive tape may have properties that change over its length.

Fibers

The yarns or threads used for the knitwear of the present invention usually comprise fibers. As was explained above, a flexible structure which is rather thin in relation to its length is referred to as a fiber. Very long fibers of virtually unlimited length with regard to their use, are referred to as filaments. Fibers are spun or twisted into threads or yarns. Fibers may also be long and may be twirled into a yarn. Fibers may consist of natural or synthetic materials. Natural fibers are environmentally friendly, because they are compostable and renewable and/or consist of renewables. Natural fibers include cotton, wool, alpaca, hemp, coconut fibers or silk, for example. Among the synthetic fibers are polymer-based fibers such as Nylon™, polyester, elastane or spandex, or Kevlar™, which may be produced as classic fibers, high-performance fibers, or technical fibers.

In some embodiments, a bag according to the invention may be assembled from various parts. For example, one part may be weft-knitted or a warp-knitted using natural yarn made from natural fibers, and another part may use plastic.

Figure 5:
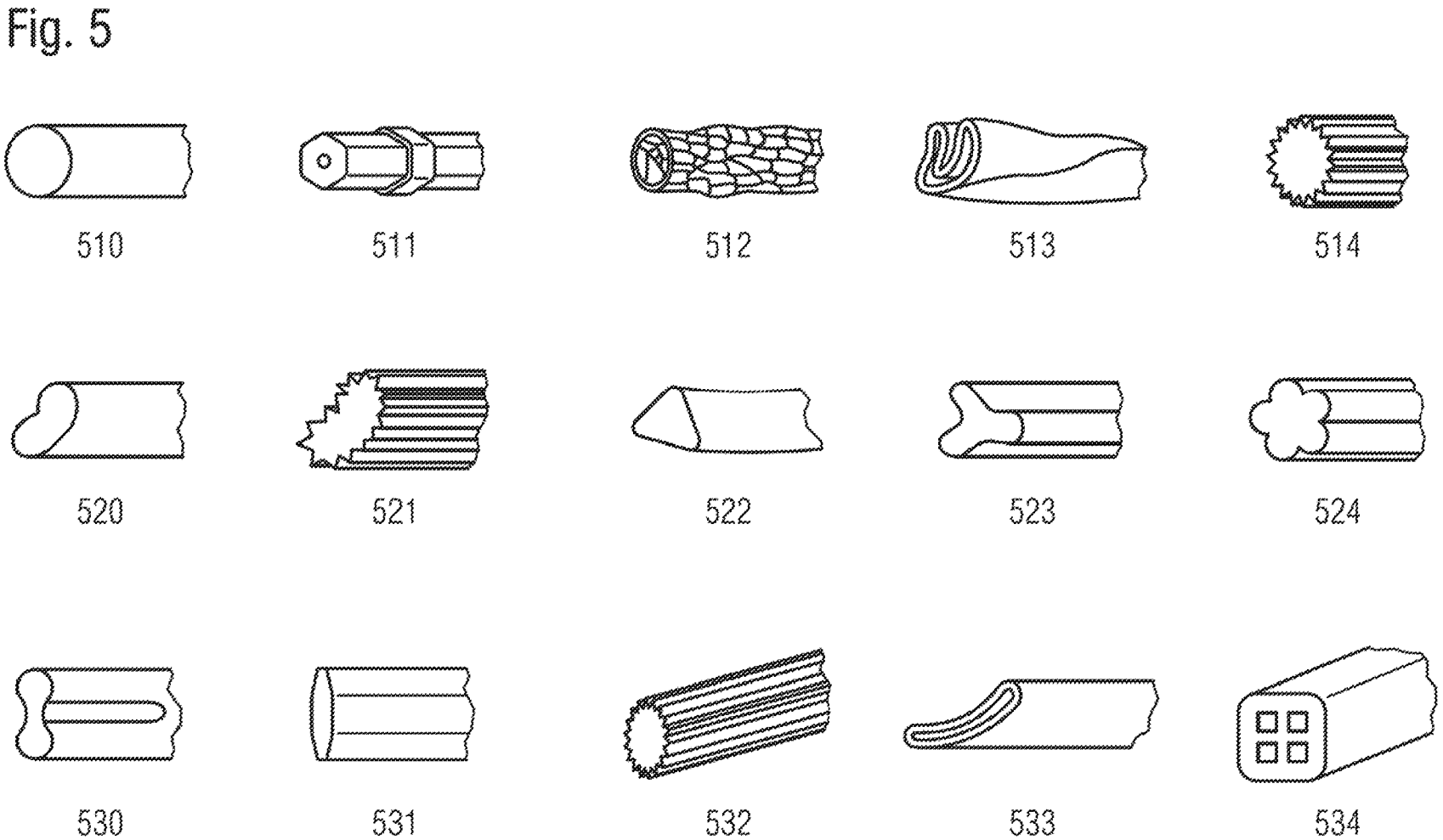
FIG. 5 shows cross-sectional views of fibers for yarns used in knitwear, which may be used for the present invention.

The mechanical and physical properties of a fiber and a yarn manufactured therefrom are also determined by the fiber's cross-section, as illustrated in FIG. 5. These different cross-sections, their properties, and examples of materials having such cross-sections will be explained in the following description.

A fiber having a circular cross-section 510 may either be solid or hollow. A solid fiber is the most frequent type, and allows easy bending and is soft to the touch. A hollow circle fiber with the same weight/length ratio as the solid fiber has a larger cross-section and is more resistant to bending. Examples of fibers with a circular cross-section are Nylon™, polyester and Lyocell.

A fiber having a bone-shaped cross-section 530 has a property of wicking moisture. Examples of such fibers are acrylic or spandex. Concave areas in the middle of the fiber support moisture being passed on in a longitudinal direction, with moisture being rapidly wicked from a certain place and distributed.

The following further cross-sections are illustrated in FIG. 5:

- Polygonal cross-section 511 with flowers; example: flax;
- Oval to round cross-section 512 with overlapping sections; example: wool;
- Flat, oval cross-section 513 with expansion and convolution; example: cotton;
- Circular, serrated cross-section 514 with partial striations; example: rayon;
- Lima bean cross-section 520; smooth surface;
- Serrated lima bean cross-section 521; example: Avril™ rayon;
- Triangular cross-section 522 with rounded edges; example: silk;
- Trilobal star cross-section 523; like triangular fiber with shinier appearance;
- Clubbed cross-section 524 with partial striations; sparkling appearance; example: acetate;
- Flat and broad cross-section 531; example: acetate in another design;
- Star-shaped or concertina cross section 532;
- Cross-section 533 in the shape of a collapsed tube with a hollow center; and
- Square cross-section 534 with voids; example: AnsoIV™ nylon.

In the context of the present invention basalt fibers may be used beneficially as well. Individual fibers and their respective properties, which are relevant for the manufacture of knitwear for the present invention, are described below:

- aramid fibers: good resistance to abrasion and organic solvents; non-conductive; temperature-resistant up to 500° C.
- para-aramid fibers: known under trade names Kevlar™, Techova™ and Twaron™; outstanding strength-to-weight properties; high Young's modulus and high tensile strength (higher than with meta-aramides); low stretching and low elongation at break (approx. 3.5%); difficult to dye.
- meta aramides: known under trade names Numex™, Teijinconex™, New Star™, X-Fiper™.
- dyneema fibers: highest impact strength of any known thermoplastics; highly resistant to corrosive chemicals, with the exception of oxidizing acids; extremely low moisture absorption; very low coefficient of friction, which is significantly lower than that of Nylon™ and acetate and comparable to Teflon; self-lubricating; highly resistant to abrasion (15 times more resistant to abrasion than carbon steel); nontoxic.
- carbon fiber: an extremely thin fiber about 0.0005-0.010 mm in diameter, composed essentially of carbon atoms; highly stable with regard to size; one yarn is formed from several thousand carbon fibers; high tensile strength; low weight; low thermal expansion; thermal conductivity and electric conductivity.
- glass fiber: high ratio of surface area to weight; with the increased surface making the glass fiber susceptible to chemical attack; by trapping air within them, blocks of glass fibers provide good thermal insulation; thermal conductivity of 0.05 W/(m×K); the thinnest fibers are the strongest because the thinner fibers are more ductile; the properties of the glass fibers are the same along the fiber and across its cross-section, since glass has an amorphous structure; moisture accumulates easily, which may worsen microscopic cracks and surface defects and lessen tensile strength; correlation between bending diameter of the fiber and the fiber diameter; thermal, electrical and sound insulation; higher stretching before it breaks than carbon fibers.

Yarn:

A plurality of different yarns may be used for the manufacture of knitwear. As was already defined, a structure of one or several fibers, which is long in relation to its diameter, is referred to as a yarn.

Functional yarns are capable of transporting moisture, and thus may absorb sweat and moisture. Functional yarns may be electrically conducting, self-cleaning, thermally regulating and insulating, flame resistant, and UV-absorbing, and may enable infrared remission. Functional yarns may be suitable for sensorics. Antibacterial yarns, such as silver yarns, for example, prevent odor formation.

Stainless steel yarn contains fibers made of a blend of Nylon™ or polyester and steel. Stainless steel yarn's properties include high abrasion resistance, higher cut resistance, high thermal abrasion, high thermal and electrical conductivity, and higher tensile strength.

In textiles made from knitwear, electrically conducting yarns may be used for integration of electronic devices. Electrically conducting yarns may, for example, forward impulses from sensors to devices for processing the impulses, or the yarns may function as sensors themselves, and measure electric streams on the skin or physiological magnetic fields, for example. Examples for the use of textile-based electrodes may be found in European patent application EP 1 916 323.

Fusible yarns may be a mixture of a thermoplastic yarn and a non-thermoplastic yarn. There are essentially three types of fusible yarns: a thermoplastic yarn surrounded by a non-thermoplastic yarn; a non-thermoplastic yarn surrounded by a thermoplastic yarn; and pure fusible yarn of a thermoplastic material. After being heated to its respective melting temperature, thermoplastic yarn fuses with the non-thermoplastic yarn (e.g. polyester or Nylon™), stiffening the knitwear. The melting temperature of the thermoplastic yarn is determined accordingly and is usually lower than that of the non-thermoplastic yarn in case of a mixed yarn.

A shrinking yarn is a dual-component yarn. The outer component is a shrinking material, which shrinks when a defined temperature is exceeded. The inner component is a non-shrinking yarn, such as polyester or nylon. Shrinking increases the stiffness of the textile material.

Additional yarns for use in knitwear are luminescent or reflecting yarns and so-called "intelligent" yarns. Examples of intelligent yarns are yarns which react to humidity, heat or cold and alter their properties accordingly, for example, contracting and thus making the stitches smaller or changing their volume and thus increasing permeability to air. Yarns made from piezo fibers or yarn coated with a piezo-electrical substance are able to convert kinetic energy or changes in pressure into electricity, which may provide energy to sensors, transmitters or accumulators, for example.

Yarns may also be equipped, for example coated, to maintain certain properties, such as stretching, water resistance/repellency, color, or humidity resistance.

Polymer Coating

Due to its structure, weft-knitted or warp-knitted knitwear is considerably more flexible and stretchable than weaved textile materials. For certain applications and requirements, it is therefore necessary to reduce flexibility and stretchability of weft-knitted or warp-knitted knitwear to achieve sufficient stability.

For that purpose, a polymer layer may be applied to one side or both sides of knitwear (weft-knitted or warp-knitted fabric), but generally also to other textile materials. The polymer layer causes a reinforcement and/or stiffening of the knitwear. In a bag according to the present invention, the polymer layer may, for example, serve the purpose of supporting, stiffening, and/or reducing elasticity in a bottom area of the bag, which is in regular contact with the ground or, in case of a backpack, in an area being in contact with a back of a person wearing the backpack. Furthermore, elasticity of the knitwear, and particularly stretchability are reduced. Moreover, the polymer layer protects the knitwear against abrasion. Furthermore, the polymer coating may give the knitwear a three-dimensional shape by compression-molding. The polymer coating may be thermoplastic urethane (TPU), for example.

In a step of polymer coating, the polymer material is applied to one side of the knitwear. It may also be applied on both sides, however. The material may be applied by spraying on, coating with a coating knife, laying on, printing on, sintering, ironing on or spreading. If the polymer material is in the form of a film, the film is placed on the knitwear and connected with the knitwear by heat and pressure, for example. The most important method of applying is spraying on, which may be carried out by a tool similar to a hot glue gun. Spraying on enables the polymer material to be applied evenly in thin layers. Moreover, spraying on is a fast method. Effect pigments such as color pigments, for example, may be mixed into the polymer coating.

The polymer is applied in at least one layer with a thickness of preferably 0.2-1 mm. One or several layers may be applied, and the layers may be of different thicknesses and/or colors. Between neighboring areas of a bag with polymer coatings of various thicknesses, there may be continuous transitions from areas with a thin polymer coating to areas with a thick polymer coating. In the same manner, different polymer materials may be used in different areas.

During application, polymer material attaches itself to points of contact or points of intersection, of yarns of the knitwear, on the one hand, and to gaps between yarns, on the other hand, forming a closed polymer surface on the knitwear. However, in case of larger mesh openings or holes in the textile structure, this closed polymer surface may also be intermittent, for example, to enable airing. The intermittence of the closed polymer surface also depends on the thickness of the applied material: the more thinly the polymer material is applied, the easier it is for the closed polymer surface to be intermittent. The polymer material may also penetrate the yarn and soak it, which contributes to the yarn's stiffening.

After application of the polymer material, the knitwear is pressed in a press under heat and pressure. The polymer material liquefies in this step and fuses with the yarn of the textile material.

In an optional step, the knitwear may be pressed into a three-dimensional shape in a machine for compression-molding. After pressing and molding, the reaction time until complete stiffening may be one to two days, depending on the polymer material used.

The following polymer materials may be used: polyester; polyester-urethane pre-polymer; acrylate; acetate; reactive polyolefins; co-polyester; polyamide; co-polyamide; reactive systems (mainly polyurethane systems reactive with $H_2O$ or $O_2$); polyurethanes; thermoplastic polyurethanes; and polymeric dispersions.

The described polymer coating may be used wherever support functions, stiffening, increased abrasion resistance, elimination of stretchability, increase of comfort, increase of friction and/or fitting to prescribed three-dimensional geometries are desired. In some embodiments, applying polymer material to the bag and then adapting the shape of the bag under heat may fit the bag to an individual shape.

Additionally, or alternatively to a reinforcing polymer coating, knitwear may be provided with a water-repellent coating to avoid, or at least reduce permeation of humidity. The water-repellent coating may be applied to the entire bag or only a part thereof, for example in a bottom area. Water-repellent materials may be based, for example, on hydrophobic materials such as polytetrafluoroethylene (PTFE), wax or white wax. A commercially available coating is Scotchgard™ from 3M.

In the context of the present invention, knitwear may also be provided with a coating of UV glue. UV glue may be applied in liquid form, for example, by spraying or painting and cures under UV light by a photochemical process. The knitwear then stiffens in areas where the UV glue is applied. Other properties may be provided by UV glue as well, such as reinforcement, water or moisture repellency, and abrasion resistance.

Monofilaments for Reinforcement

As was already defined, a monofilament is a yarn consisting of one single filament, that is, one single fiber. Therefore, stretchability of monofilaments is considerably lower than that of yarns, which are manufactured from many fibers. Monofilaments are typically made from polyamide. However, other materials, such as polyester or a thermoplastic material, may be used.

Although a knitwear made from a monofilament is considerably more rigid and less stretchable, this knitwear does not have the desired surface properties such as smoothness, colors, transport of moisture, outer appearance and variety of textile structures that other knitwear has. This disadvantage is overcome by the knitwear described below.

Figure 6:
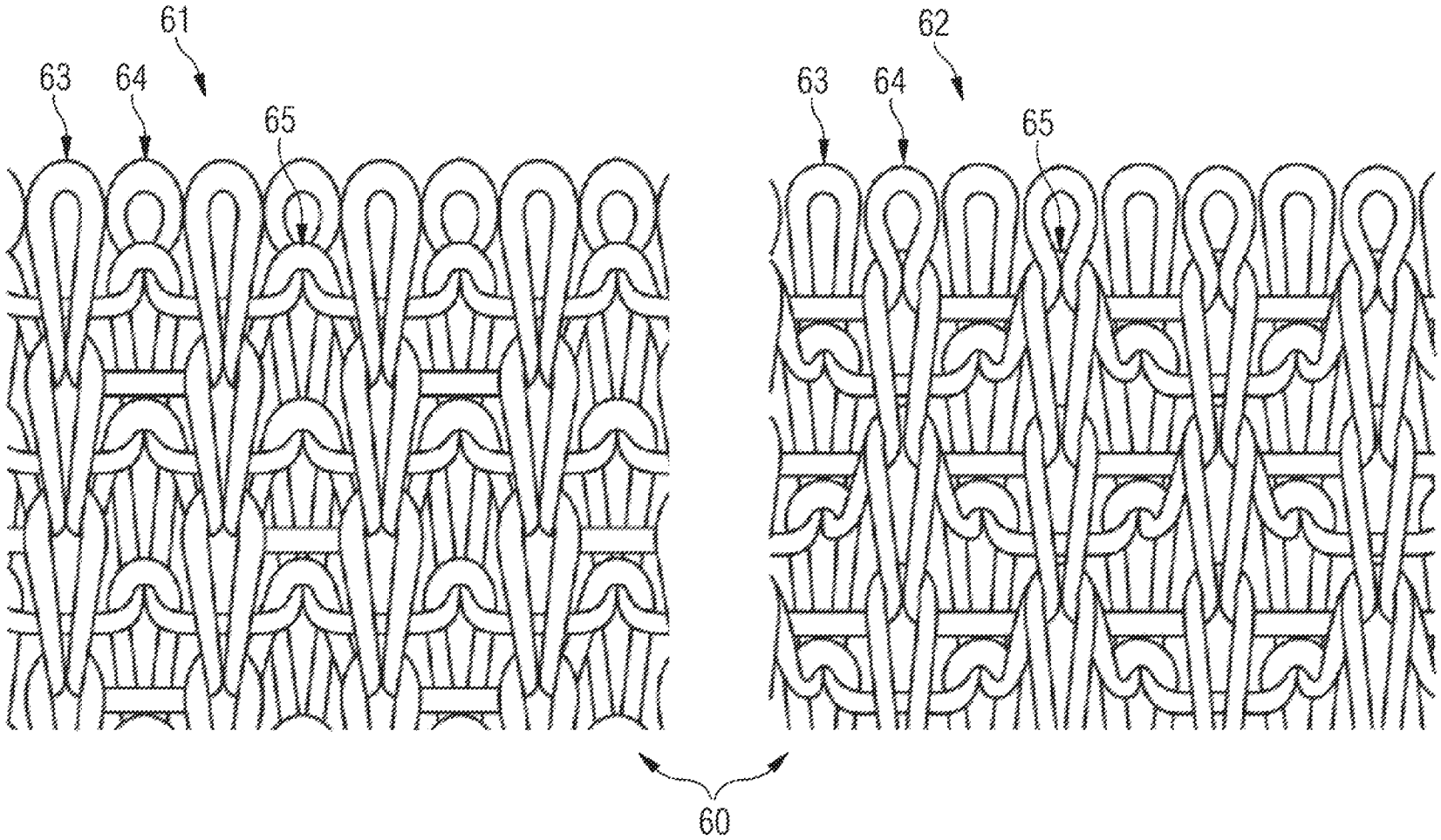
FIG. 6 is an example of knitwear comprising a monofilament yarn.

FIG. 6 depicts a weft-knitted fabric having a weft-knitted layer made from a first yarn, such as a multi-fiber yarn, for example, and a weft-knitted layer made from monofilament. The layer of monofilament is knitted into the layer made from the first yarn. The resulting two-layered knitwear is considerably more solid and less stretchable than the layer made from yarn alone.

FIG. 6 particularly depicts a front view 61 and a back view 62 of a two-layered knitwear 60. Both views show a first weft-knitted layer 63 made from a first yarn and a second weft-knitted layer 64 made from monofilament. The first layer 63 made from the first yarn is connected to the second layer 64 by stitches 65. Thus, the greater solidness and smaller stretchability of the second textile layer 64 made from the monofilament is transferred to the first textile layer 63 made from the first yarn.

A monofilament may also be melted slightly to connect with the layer of the first yarn and limit stretching even more. The monofilament then fuses with the first yarn at points of contact and fixates the first yarn to the layer made from monofilament.

Fusible Yarn

For reinforcement and to reduce stretching, the yarn of the knitwear may additionally, or alternatively be a fusible yarn which fixes the knitwear after pressing. There are substantially three types of fusible yarns: a thermoplastic yarn surrounded by a non-thermoplastic yarn; a non-thermoplastic yarn surrounded by a thermoplastic yarn; and a pure fusible yarn of a thermoplastic material. To improve the bond between the thermoplastic yarn and the non-thermoplastic yarn, the surface of the non-thermoplastic yarn may be texturized.

Pressing preferably takes place at a temperature ranging from 100 to 150° C., preferably at 130° C. The thermoplastic yarn melts at least partially in the process and fuses with the non-thermoplastic yarn. After pressing, the knitwear is cooled, so that the bond is hardened and fixed. The fusible yarn may be arranged in the entire knitwear or only in selective areas.

In some embodiments, the fusible yarn is weft-knitted or warp-knitted into the knitwear. In case of several layers, the fusible yarn may be knitted into one, several or all layers of the knitwear.

In other embodiments, the fusible yarn may be arranged between two layers of knitwear. In doing so, the fusible yarn may simply be placed between the layers. Arrangement between the layers has the advantage that the mold does not become dirty during pressing and molding, since there is no direct contact between the fusible yarn and the mold.

Thermoplastic Textile for Reinforcement

Another possibility for reinforcing knitwear, which is used in some embodiments of the present invention, is the use of a thermoplastic textile, which is a thermoplastic woven fabric or a thermoplastic knitwear. The thermoplastic textile fuses, at least partially, when heated, and stiffens as it cools down. A thermoplastic textile may, for example, be applied to the surface of the knitwear by applying pressure and heat. When it cools down, the thermoplastic textile stiffens and specifically reinforces the bag in the area in which it was placed.

The thermoplastic textile may be manufactured specifically for reinforcement regarding its shape, thickness and structure. Additionally, its properties may be varied in certain areas. The stitch structure, the knitting stitch and/or the yarn used may be varied such that different properties are achieved in different areas.

The thermoplastic textile may be a weft-knitted fabric or a warp-knitted fabric made from a thermoplastic yarn. Additionally, the thermoplastic textile may also comprise a non-thermoplastic yarn. The thermoplastic textile may be applied to the bag, for example, by pressure and heat.

The thermoplastic textile may be a woven fabric whose wefts and/or warps are made from a thermoplastic material. Different yarns may be used in the weft direction and the warp direction of the thermoplastic woven fabric, so as to achieve different properties, such as stretchability, in the weft direction and the warp direction.

The thermoplastic textile may be a spacer weft-knitted fabric or a spacer warp-knitted fabric made from a thermoplastic material. In this regard, only one layer may be made from the thermoplastic material, for example, so as to be attached to the bag. Alternatively, both layers may be made from the thermoplastic material.

A thermoplastic weft-knitted fabric or warp-knitted fabric may be manufactured using the manufacturing techniques for knitwear described above in the section "Knitwear".

A thermoplastic textile may be connected with a surface to be reinforced only partially subject to pressure and heat so that only certain areas or only a certain area of the thermoplastic textile connects to the surface. Other areas, or another area do not connect to the surface, so that air permeability is maintained in those areas, for example.

All of the different knitting, coating and reinforcement techniques described thus far, may be used in the context of the present invention, and for bags to be described below.

Embodiments of Bags According to the Invention

In the following, certain embodiments of a bag, according to the invention, are described. These descriptions are valid for a method of manufacturing such a bag as well.

Figure 7A:
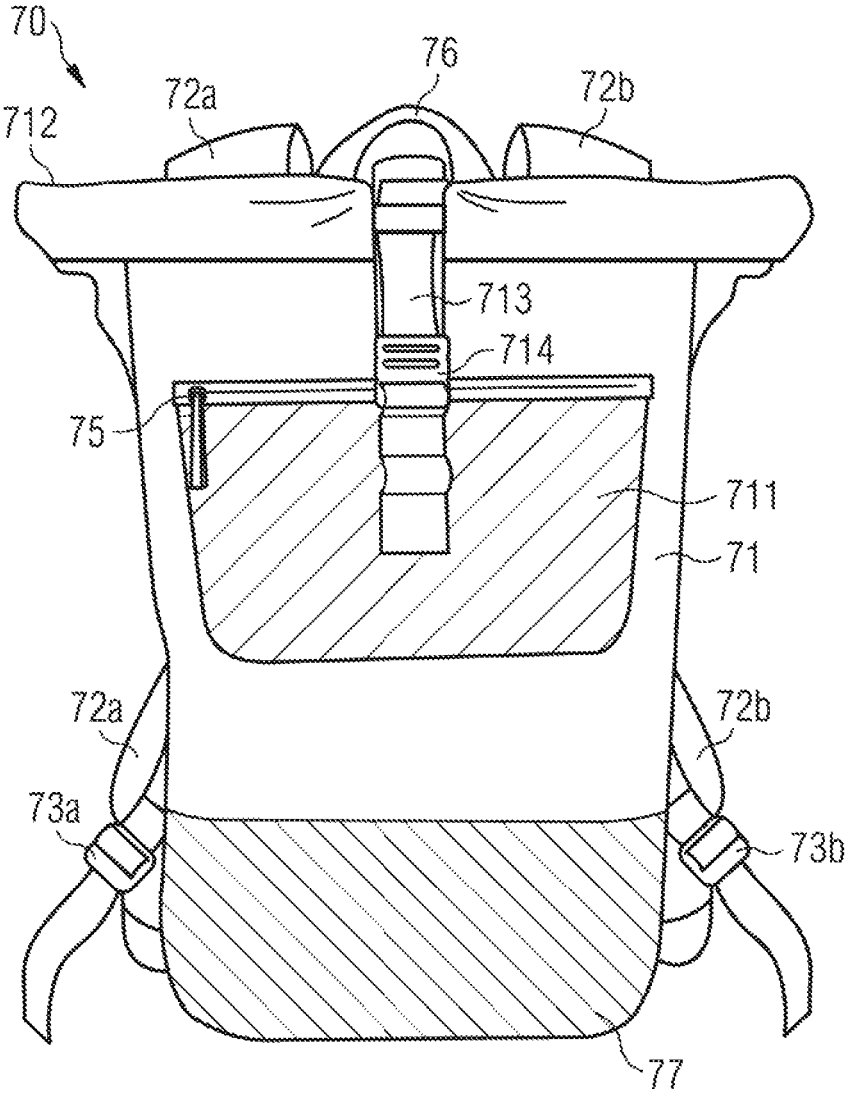
FIGS. 7A, 7B and 7C are perspective views of a bag, according to some embodiments of the present invention.
Figure 7B:
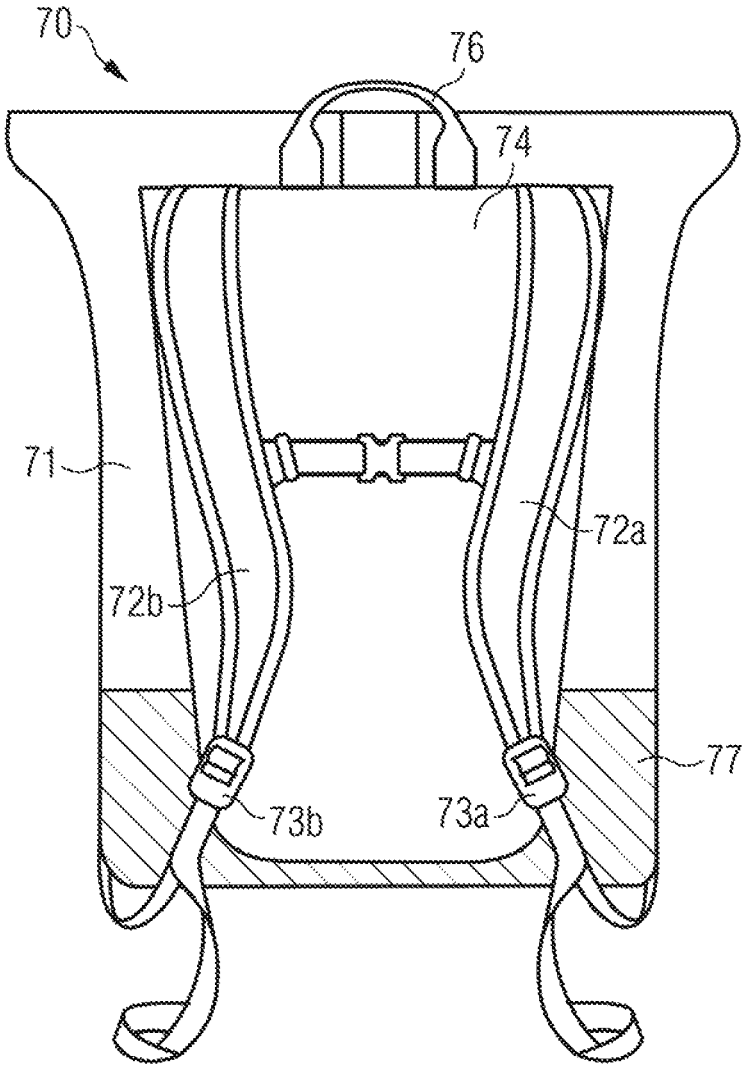
Figure 7C:
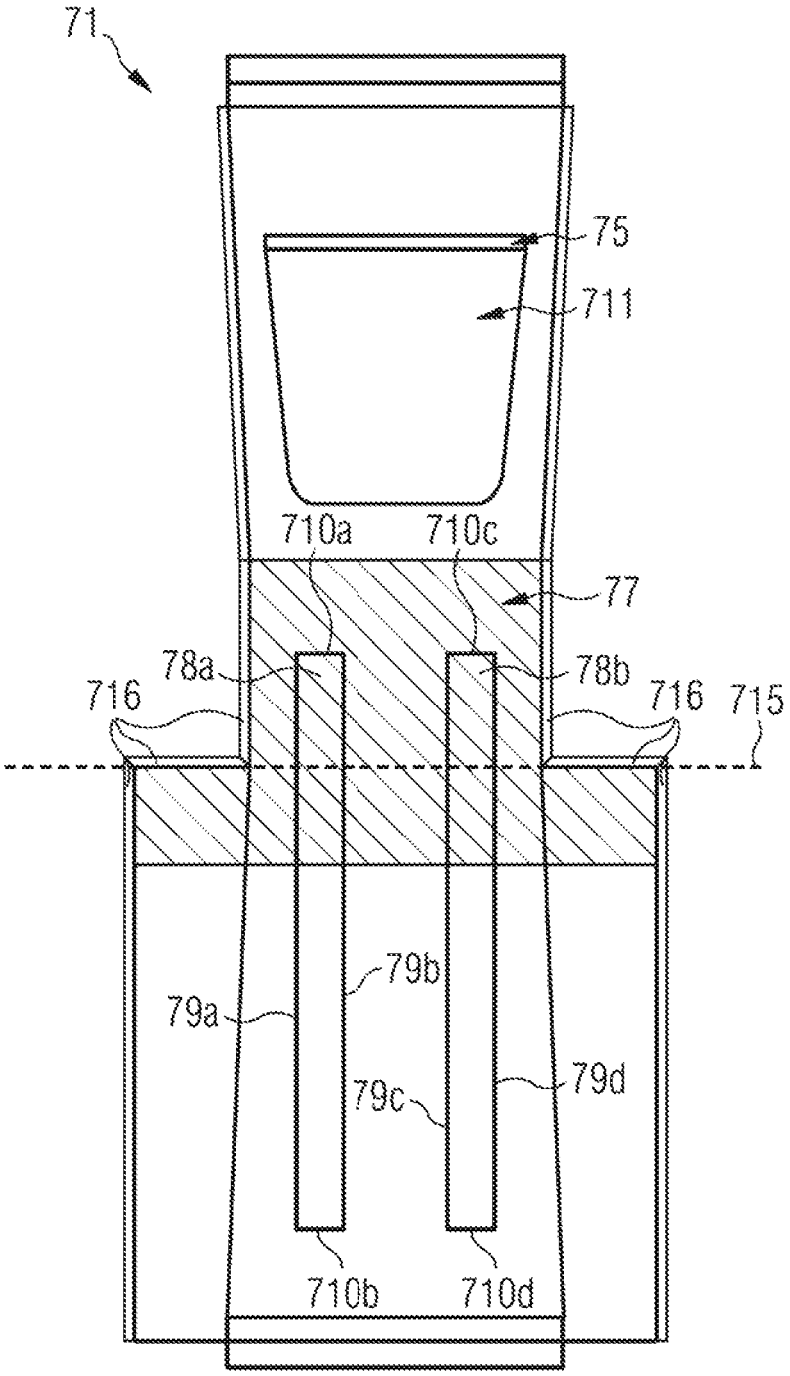

FIGS. 7A, 7B and 7C show some embodiments of a bag 70 according to the invention. The bag 70 according to the embodiments in FIGS. 7A, 7B and 7C is a backpack. The bag 70 comprises a sack-like body 71, which comprises a knitwear and two shoulder straps 72*a* and 72*b*. The sack-like body 71 is usually carried on a person's back and secured with the two shoulder straps 72*a* and 72*b* that go over the person's shoulders.

The sack-like body 71 of the backpack 70 is a part of the bag containing items which are usually packed in the backpack 70, such as sports equipment (like a soccer ball, basketball, shin guards, rackets) and/or apparel (like shoes, a jersey, a t-shirt, underwear, sports pants). The backpack 70 may also be used for activities other than sports, and may store other items such as a notebook, smartphone, tablet computer, food and beverages, and school/work items as well. This is also true for further embodiments.

The two shoulder straps 72*a* and 72*b* may be knitted in one piece together with the knitwear of the backpack 70 (similar to some embodiments of a backpack described with reference to FIGS. 8A and 8B), or may be added to the knitwear in an additional step. The knitwear may be knitted on a suitable machine with suitable yarns as described in detail above. The shoulder straps 72*a* and 72*b* contain length adjusting mechanisms 73*a* and 73*b* for adapting the length of the shoulder straps 72*a* and 72*b*, so that the backpack 70 may be worn comfortably by persons of different sizes. While the length adjusting mechanisms 73*a* and 73*b* shown in FIGS. 7A and 7B comprise buckles, other length adjusting mechanisms such as hook-and-loop fasteners or snap buttons, may be used as well. The length adjusting mechanisms 73*a* and 73*b* for adapting the length of the shoulder straps 72*a* and 72*b* are optional and may be omitted just like the shoulder straps 72*a* and 72*b* themselves may be omitted.

As shown in the rear view of FIG. 7B, the shoulder straps 72*a* and 72*b* are attached to a panel 74. The panel 74 may be manufactured in a separate step and may be inserted into a corresponding opening on a backside of the backpack 70, for example, by stitching, gluing, or welding. Alternatively, the backside of the backpack 70 may not comprise an opening and the panel 74 may be attached on top of the knitwear of the sack-like body 71, for example, by gluing, stitching, or welding. Alternatively, the panel 74 may be knitted with the knitwear of the sack-like body 71 in one piece. The panel 74 may also contain a cushioning (a foamed material, spacer knit or mesh, or an air bladder) and/or may be made from a rather stiff material. The panel 74 is optional, so the backside of the bag 70 may comprise the knitwear and the shoulder straps 72*a* and 72*b* may be attached to the knitwear. In this case, cushioning may be provided as described below with respect to FIG. 7C.

Instead of two shoulder straps 72*a* and 72*b*, the backpack 70 may also comprise a single shoulder strap. The single shoulder strap may be arranged on the sack-like body 71 in a diagonal manner, such that the shoulder strap runs diagonally over the upper torso of a person wearing the backpack 70. The single shoulder strap may optionally be equipped with a length adjusting mechanism for adapting the length of the shoulder strap as well.

The sack-like body 71 comprises a knitwear being knitted in one piece. In the embodiments of FIGS. 7A, 7B and 7C, the sack-like body 71 is almost entirely made from a one-piece knitwear 717, exceptions being a zipper 75, an optional loop 76 and a coating 77 on a bottom of the bag 70.

The one-piece knitwear 717 may be manufactured on a suitable machine as described in detail above.

As may be seen in more detail in the schematic drawing of FIG. 7C, which shows the sack-like body 71 before it is stitched together to form the backpack 70 shown in FIGS. 7A and 7B, the one-piece knitwear 717 comprises a first layer and a second layer, wherein the first layer at least partly overlaps the second layer, and the first layer and the second layer are knitted in a one-piece knitting process. Thus, in the embodiments of FIGS. 7A, 7B and 7C, the one-piece knitwear 717 comprises two overlapping (in fact congruent) layers in areas 78*a* and 78*b*. In the remaining part of the one-piece knitwear 717, the one-piece knitwear 717 comprises only a single layer. In each of the two areas 78*a* and 78*b*, the two layers are joined along lines 79*a* and 79*b* (for area 78*a*), and 79*c* and 79*d* (for area 78*b*). The two layers are not joined along lines 710*a* and 710*b* (for area 78*a*), and 710*c* and 710*d* (for area 78*b*) and accordingly form corresponding openings. Thus, in each of the two areas 78*a* and 78*b*, the two layers form two opposite openings and create a tunnel in the area 78*a* and 78*b*, respectively. The tunnels may be used for inserts like cushionings, padding or reinforcing members. The tunnel may be closed after the insert has been placed inside the tunnel, for example, by stitching, gluing or welding. Instead of tunnels, the areas 78*a* and 78*b* may form a pocket, if the two layers are joined such that they form a single opening which is closed after the insert has been inserted. More than two layers may be used as well, for example three or four, to enhance the stability.

In the embodiments of FIGS. 7A, 7B and 7C, the tunnels in the areas 78*a* and 78*b* are filled with a padding to make the backpack 70 more comfortable to wear. The paddings are arranged on the backside of the backpack along a left side and a right side of a person's spine. A foamed material or a spacer knit, as described above, may be used as padding. Furthermore, an air bladder or reinforcing materials like hard plastics or metals (such as alloy) may be inserted into the tunnels to stabilize a back portion of the backpack 70.

The tunnels in the areas 78*a* and 78*b* are optional and that instead of tunnels, the backpack 70 may comprise a panel with cushioning members and/or reinforcements, as was described with respect to FIG. 7B. Furthermore, cushioning members and/or reinforcements may be provided to the backpack 70 separately. For example, pads may be stitched, glued or welded to the backpack to the backside of the backpack 70 or at other areas.

Furthermore, the one-piece knitwear 717 of the bag 70 of the embodiments of FIGS. 7A, 7B and 7C comprises a first layer and a second layer, wherein the first layer at least partly overlaps the second layer, and wherein the first layer and the second layer are knitted integrally in a one-piece knitting process to form a pocket 711. Thus, the pocket 711 is integrally formed during the knitting of the one-piece knitwear 717 and no additional step of attaching the pocket to the one-piece knitwear 717 is needed. The pocket 711 comprises a zipper 75 for opening and closing the pocket 711. More than two integral layers may be used as well, for example, three or four, to enhance the stability.

In general, the backpack 70 may comprise more than one pocket or no pocket at all. The pockets may be knitted with the one-piece knitwear 717 in a single knitting process as described above, or may be attached to the one-piece knitwear 717 in another step. Pockets may be made of a closed or an open mesh. The pockets may be placed inside the sack-like body 71 or outside of the sack-like body 71.

Instead of the zipper 75, other mechanisms of closing the pocket 711 may be used, such as a snap button, a hook-and-loop fastener or a magnetic closure. The pocket 711 may also comprise no closure member at all.

The coating 77 on the one-piece knitwear 717 may be based on TPU or UV glue. Also, a polymer coating as described above may be used. The coating 77 may increase abrasion resistance, stiffness, dimensional stability and water repellency of the one-piece knitwear 717.

The backpack 70 comprises an opening 712, which provides access a the main compartment of the sack-like body 71. The opening 712 is closed by rolling an upper part of the backpack 70, resulting in a rolled part. The rolled part of the backpack 70 is fixed by a closing webbing 713 which is secured by a securing mechanism 714. The securing mechanism 714 in the embodiments of FIGS. 7A, 7B and 7C is a hook. Instead of a hook, a snap button or a hook-and-loop fastener may be used. The rolled part of the backpack 70 may comprise reinforcing lids, which provide a secure closing of the opening 712 by exerting pressure against each other. The opening 712 may additionally, or alternatively be closed by a zipper, a magnet, a snap button, or a hook-and-loop fastener, for example. The closing webbing 713 and the securing mechanism 714 are optional elements of the backpack 70.

The one-piece knitwear 717 shown in FIG. 7C is formed into a backpack 70 as shown in FIGS. 7A and 7B, by folding the one-piece knitwear 717 along dashed line 715 in FIG. 7C. In another step, the backpack 70 is stitched together either by a stitching machine or by hand, along line 716. In general, the coating 77 and/or the zipper 75 and/or additional pockets or applications may be applied to the backpack 70 in an additional step, either before or after stitching the backpack 70 together.

The main compartment of the sack-like body 71 as well as every pocket of the backpack 70 may optionally comprise a lining which is added in another step, either before or after the backpack 70 is stitched together. The lining may be made from a textile material such as a woven or knit, or a mesh. The lining may be glued, stitched or welded to the main compartment and/or additional pockets. Alternatively, the lining may be integrally formed in a one-piece knitting process with the one-piece knitwear 717 of the backpack 70 as at least one layer of the one-piece knitwear 717.

Figure 8A:
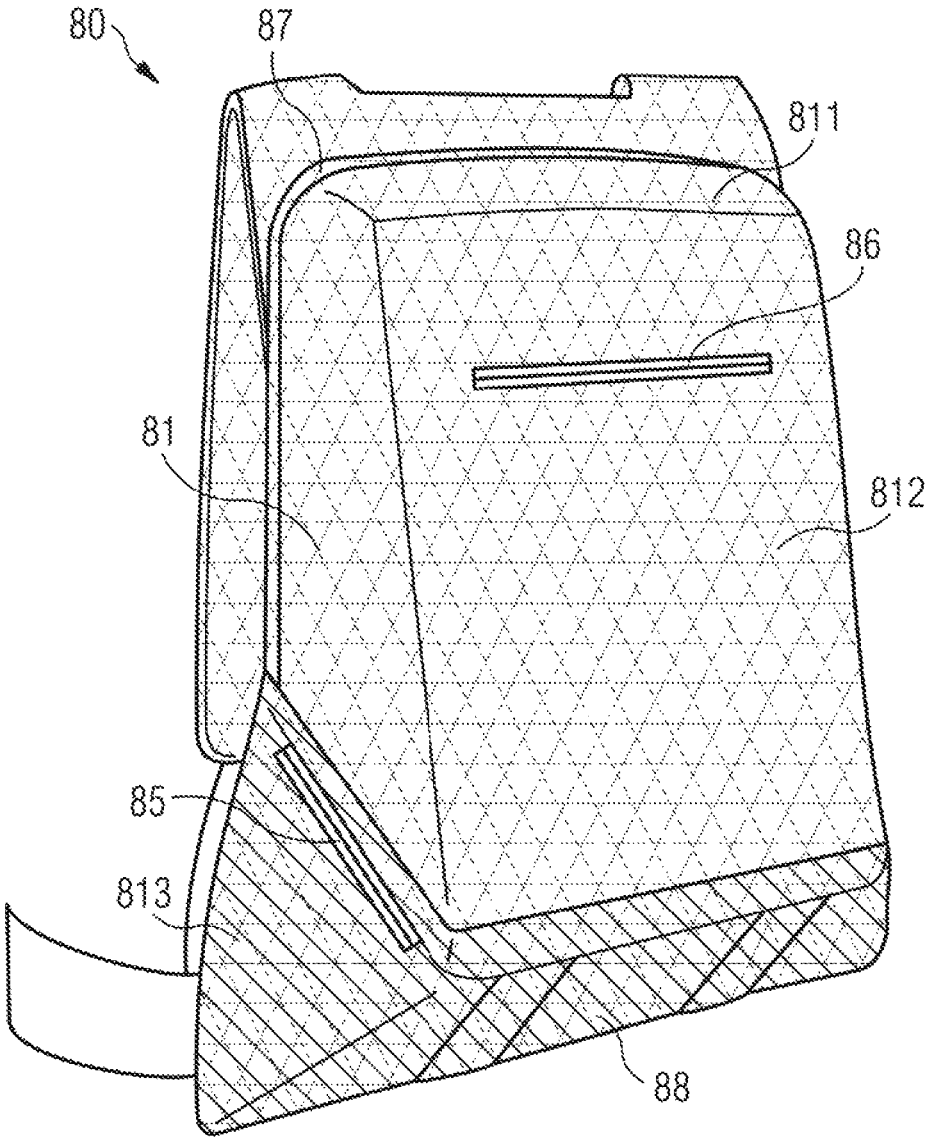
FIGS. 8A and 8B are perspective views of a bag, according to certain embodiments of the present invention.
Figure 8B:
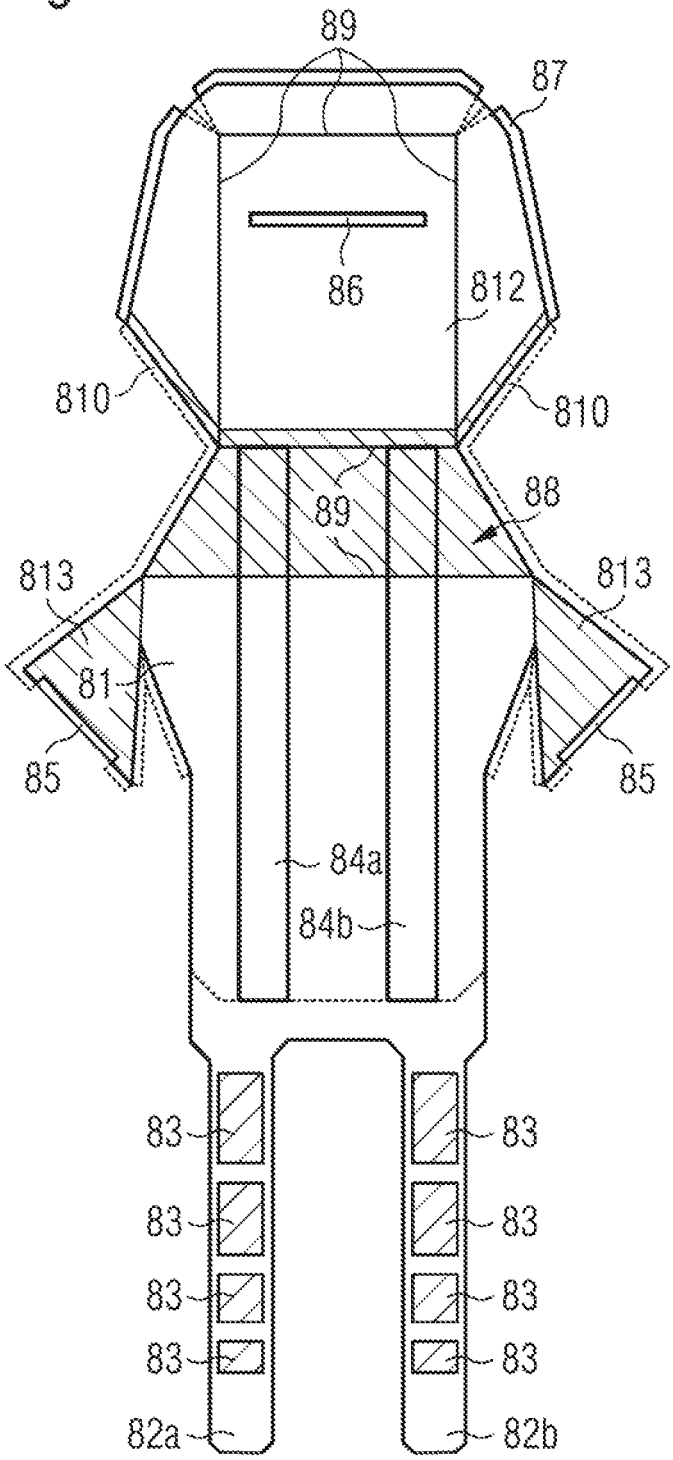

FIGS. 8A and 8B show other embodiments of a bag 80, according to the present invention. The bag 80 is a backpack and comprises a sack-like body 81 made from a knitwear 811. The knitwear 811 may be knitted on a suitable machine with suitable yarns as described in detail above. The embodiments of FIGS. 8A and 8B comprises shoulder straps 82*a* and 82*b* (shown in FIG. 8B), which are integrally formed as one piece with the sack-like body 81, (the sack-like body 81 and the shoulder straps 82*a* and 82*b* are formed in a single knitting process).

The shoulder straps 82*a* and 82*b* may contain length adjusting mechanisms for adapting the length of the shoulder straps 82*a* and 82*b*, so that the backpack 80 may be comfortably worn by persons of different sizes. The length adjusting mechanisms may, for example, comprise a buckle, a hook-and-loop fastener or snap buttons.

The shoulder straps 82*a* and 82*b* comprise an open knit structure in areas 83. In these areas 83, a mesh structure of the knitwear 811 comprises larger mesh openings than in other areas of the knitwear 811. In this way, air permeability is improved in the areas 83. The mesh openings may be larger only on one side of the shoulder straps 82*a* and 82*b*, for example, the mesh openings may be larger on the side facing the wearer or on the side facing away from the wearer.

Pockets or tunnels may be formed in the areas 83 for padding or cushioning inserts. Such inserts may be made from EVA, foamed material, air bladders, spacer mesh or spacer knit (as described before), or other suitable materials.

Instead of two shoulder straps 82*a* and 82*b*, the backpack 80 may comprise a single shoulder strap. The single shoulder strap may be arranged on the sack-like body 81 in a diagonal manner, such that the shoulder strap runs diagonally over an upper torso of a person wearing the backpack 80. The single shoulder strap may optionally be equipped with a length adjusting mechanism.

The knitwear 811 of the sack-like body 81 of the embodiments of FIGS. 8A and 8B comprise a first layer and a second layer knitted in a one-piece knitting process which overlap to form tunnels 84*a* and 84*b*. The tunnels 84*a* and 84*b* are filled with an EVA insert for reinforcing and/or cushioning a back of the backpack 61. Instead of EVA, other materials may be used, such as metals (e.g. alloy), other plastics, foamed materials, spacer mesh or spacer knit (as described before), or other suitable materials. More than two integral layers may be used as well, for example, three or four, to enhance the stability.

The bag 80 of the embodiments in FIGS. 8A and 8B also comprises a zipper 85 for a side pocket 813, which may be seen in both FIGS. 8A and 8B. Furthermore, a zipper 86 for a front pocket 812 and a zipper 87 for a main compartment of the knitwear 811 are shown in both FIGS. 8A and 8B. Instead of zippers 85, 86 and 87, other closure members may be used for the main compartment 811 and/or the pockets 812 and 813, such as a snap button, a hook-and-loop fastener or a magnetic closure. The pockets may also comprise no closure member at all.

In general, the backpack 80 may comprise an arbitrary number of pockets or no pocket at all. These pockets may be knitted with the knitwear 811 in a single knitting process or may be attached to the knitwear 811 in another step. Pockets may be made of a closed or an open mesh. The pockets may be placed inside the sack-like body 81 or outside the sack-like body 81.

The main compartment of the knitwear 811 as well as the pockets 812 and 813 of the backpack 80 may optionally comprise a lining which is added in another step, either before or after the backpack 80 is stitched together. The lining may be made from a textile material such as a woven or knit, or a mesh. The lining may be glued, stitched or welded to the main compartment of the knitwear 811 and/or additional pockets. Alternatively, the lining may be integrally formed in a one-piece knitting process with the knitwear 811 of the backpack 80 as at least one layer of the knitwear.

The knitwear 811 of the sack-like body 81 also comprises a coated area 88 which is located at a lower side of the bag 80, which comes into contact with the ground when the bag 80 is dropped off of a person. Thus, the coating 88 protects the knitwear 811 from humidity and dust. The coating may, for example, be thermoplastic urethane (TPU). Alternatively, or additionally, the coated area 88 may be coated with UV glue. UV glue may be applied in liquid form and cures under UV light by a photochemical process. In general, other coatings may be used as well. The coated area 88 may additionally, or alternatively comprise a fusible yarn. As described above, fusible yarns melt when heated above their respective melting temperatures and stiffen when cooling below their respective melting temperatures. Stiffened fusible yarns may provide water-repellency, abrasion-resistance and reinforcement to the coated area 88. Other areas of the bag 80 may be provided with fusible yarns as well.

The knitwear 811 may also comprises an engineered logo, a pattern, a lettering or similar, formed in the knitwear 811 during the knitting process (it is integrally formed within the knitwear 811). The logo, pattern or lettering may comprise a different colored yarn than the yarn of the surrounding area. The logo, pattern or lettering may also be stitched, embroidered, glued or printed in a separate step.

The knitwear 811 shown in FIG. 8B is formed into the backpack 80 shown in FIG. 8A by folding the knitwear 811 along line 89 in FIG. 8B. In another step, the backpack 80 is stitched together either by a stitching machine or by hand along dashed line 810. In general, coatings and/or a zipper, magnet or button, and/or additional pockets or applications may be applied to the backpack 80 in another step, either before or after stitching the backpack 80 together.

Figure 9A:
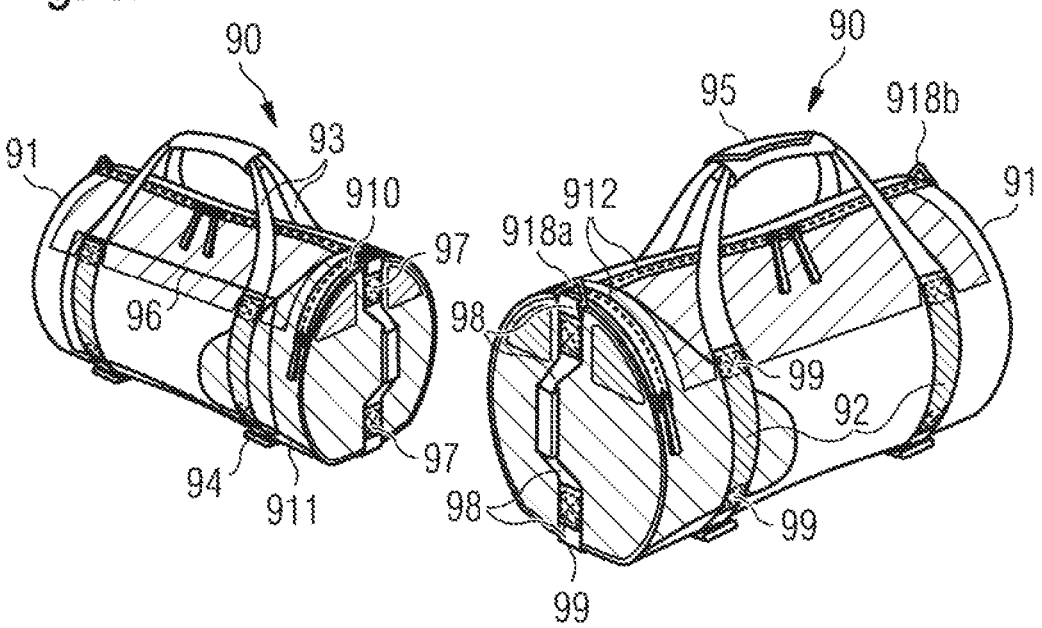
FIGS. 9A, 9B, 9C and 9D are perspective views of a bag, according to some embodiments of the present invention.
Figure 9B:
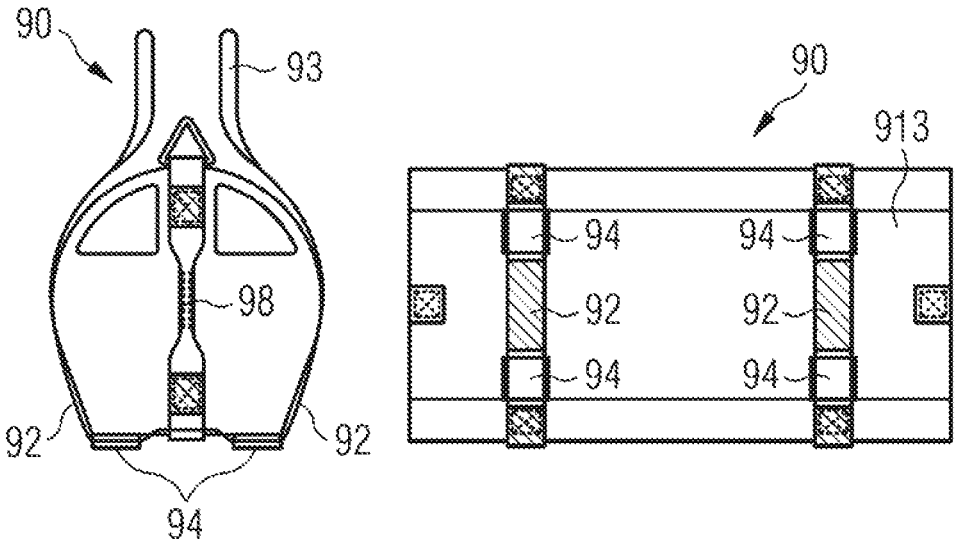
Figure 9C:
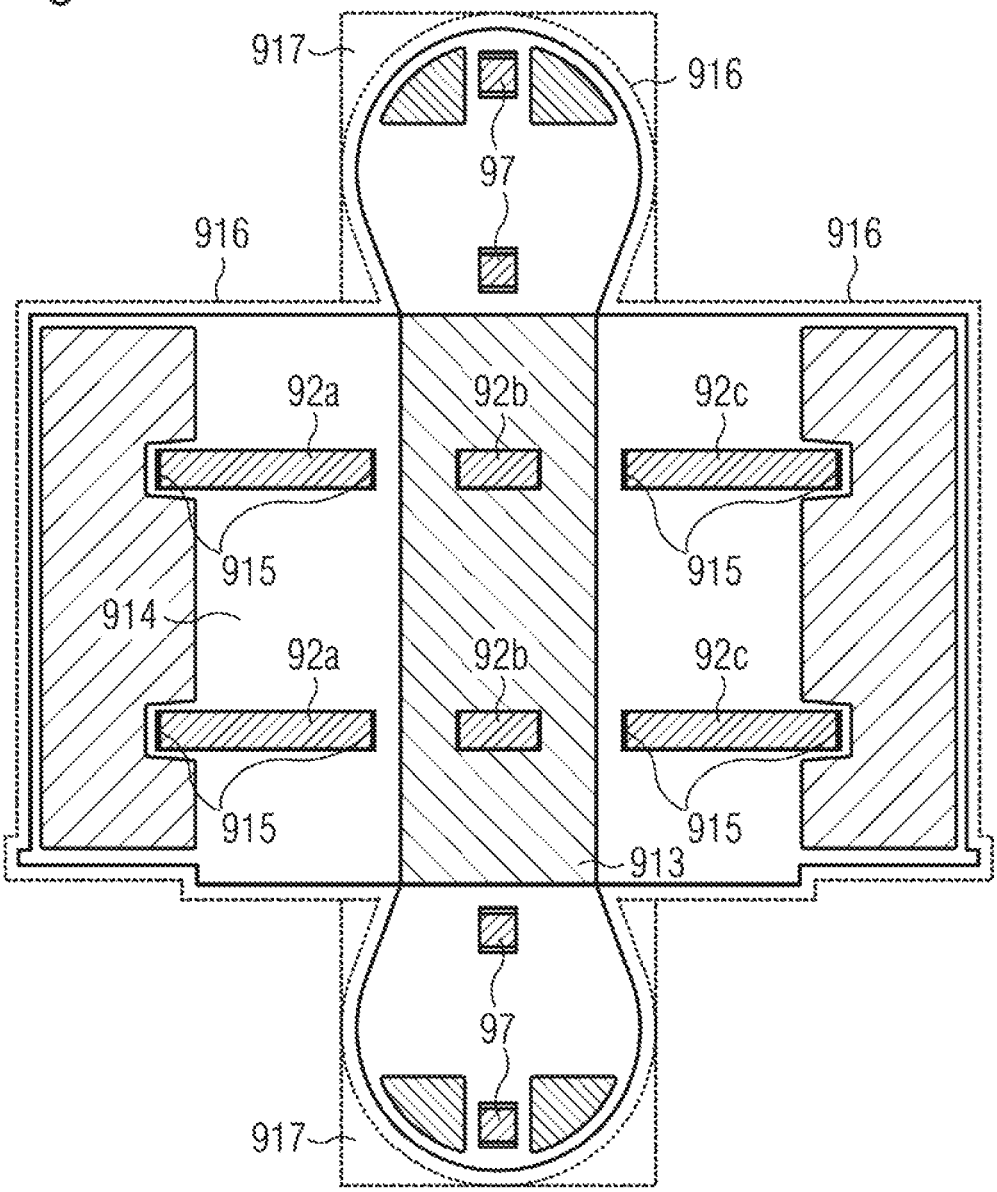

FIGS. 9A, 9B and 9C show some embodiments of a bag 90, according to the present invention, wherein the left side of FIG. 9A shows a back perspective view and the right side shows a front perspective view. The bag 90 is a sports bag for carrying sports equipment (like a soccer ball, basketball, shin guards, rackets) and corresponding apparel (like shoes, a jersey, a t-shirt, underwear, sports pants).

The sack-like body 91 of the bag 90 is made from one piece of knitwear 914. The knitwear 914 may be knitted on a suitable machine with suitable yarns as described in detail above. The knitwear 914 comprises a first and a second layer which are integrally formed within the knitwear 914 in a one-piece knitting process to form tunnels 92. Thus, the main part of the bag 90 is made from one piece of knitwear 914, and in some areas of the knitwear 914, tunnels are formed in a single knitting process. More than two integral layers may be used as well, for example, three or four, to enhance the stability.

As may be seen in more detail in the side and bottom views of FIG. 9B, each of the tunnels 92 comprises one piece of webbing running through the tunnels. The webbings create carry handles 93 and hold bottom studs 94. The carry handles 93 are held together by an optional interlock 95 which may be closed by a hook-and-loop fastener. Instead of a hook-and-loop fastener, a magnet, snap button, or other suitable closure members may be used. A plain weave lining 96 is arranged inside of the bag 90 to cover the tunnels 92. This lining 96 is optional. A lining similar to lining 96 may be arranged inside the entire bag 90.

A main compartment as well as every pocket of the bag 90 may optionally comprise a lining which is added in another step, either before or after the bag 90 is stitched together. The lining may be made from a textile material such as a woven or knit, or a mesh. The lining may be glued, stitched or welded to the main compartment and/or additional pockets. Alternatively, the lining may be integrally formed in a one-piece knitting process with the knitwear 914 of the bag 90 as at least one layer of the knitwear.

Instead of tunnels 92, pockets may be used as well. In this case, the knitwear 914 would comprise a first layer and a second layer, which are integrally formed within the knitwear 914 with a one-piece knitting process. More than two integral layers may be used as well, for example, three or four, to enhance the stability. The layers may be joined (for example, by stitching, gluing, or welding) on three sides of each pocket and one side may be left open. Each of the handles 93 may enter a respective pocket through the open side of the pocket and may be fixed in the pocket, for example by stitching, gluing or welding, either to the first layer, the second layer, or both. The handles 93 may be fixed in the tunnels in the same manner described above.

Furthermore, the tunnels 92 or pockets may contain reinforcement elements, either only at a bottom of each tunnel or pocket, or running through the entire tunnel. The handles 93 may be fixed at an upper end of the tunnel or may be fixed at a different location of the bag 90.

Figure 9D:
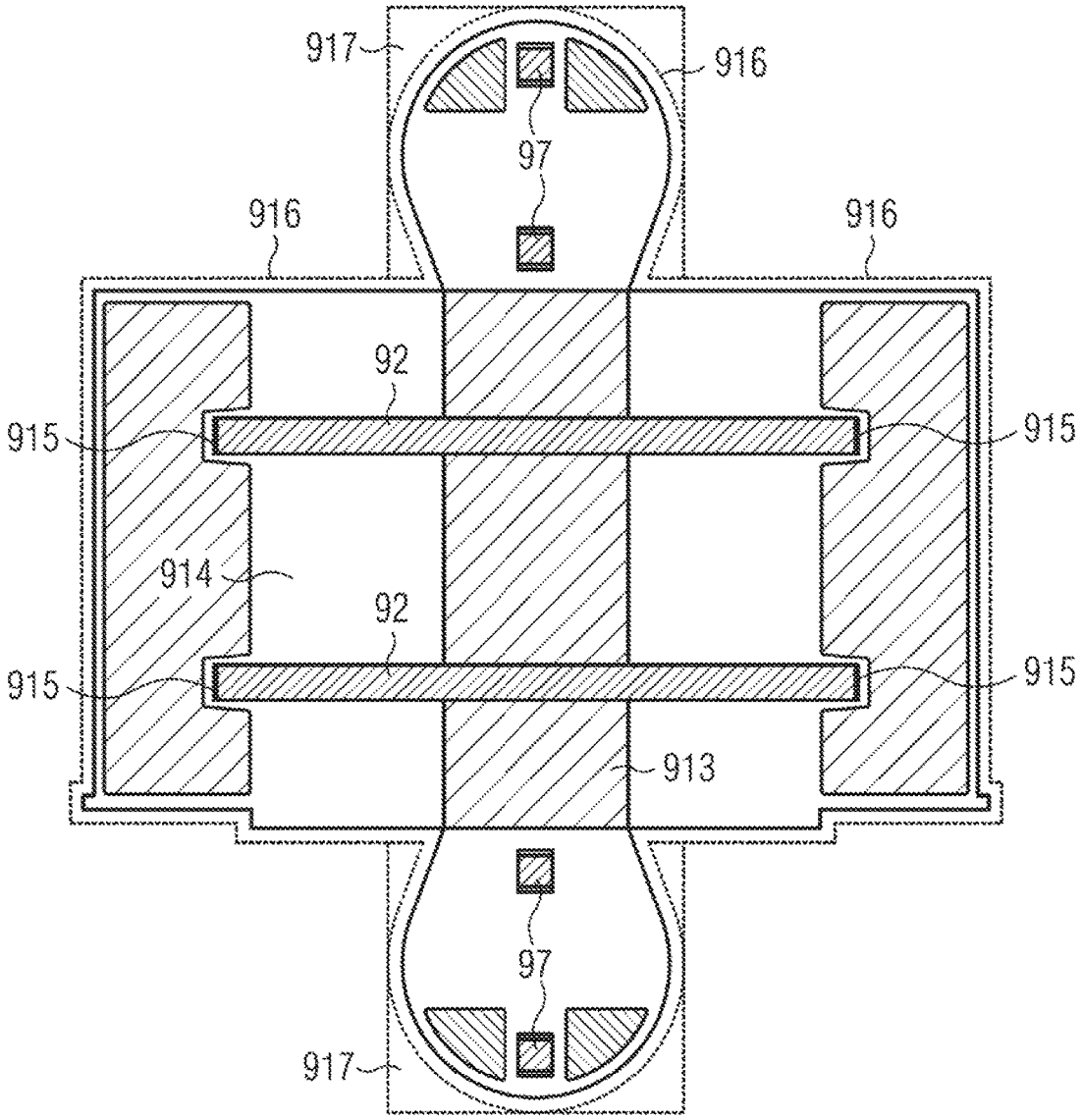

Furthermore, two tunnels 97 may be created on each side of the bag 90 by two layers of integrally formed knitwear 914, as shown in FIGS. 9C and 9D. A webbing, an example of which is depicted in FIG. 9B, with the reference numeral 98, may form a side handle that runs through the tunnels 97. The tunnels 97 and the webbings 98 are optional and different numbers of tunnels and webbings may be used. The tunnels 97 may also be stitched, glued or welded to the bag 90 in a separate step. Also, the webbing 98 may be stitched, glued or welded to one side of the bag 90, or to both sides of the bag 90.

In general, all webbings used as handles in the embodiments of FIGS. 9A, 9B and 9C may be attached by box stitching 99 for secure attachment. Other mechanisms for attaching the webbings may be used, such as gluing or welding.

The bottom studs 94 provide a stable stand to the bag 90. These studs may be made from plastic, metal (e.g. alloy) or similar material. The bottom studs 94 may be provided with an abrasion-resistant coating. The number of studs may vary and instead of four studs, the bag 90 may comprise for example four or six studs.

The bag 90 also comprises two loops 918*a* and 918*b* on opposite sides of the bag 90. The loops 918*a* and 918*b* may be made from plastic (e.g. polypropylene), metal (e.g. alloy) or similar materials. It is also possible that the loops 918*a* and 918*b* are made from a flexible material, such as textile, leather or artificial leather. A carrying strap (not shown in the figures) may be attached to the loops 918*a* and 918*b*, for example, by a hook, carabiner, hook-and-loop fastener, or button, snap button. The carrying strap may, for example, be used to carry the bag 90 over a person's shoulder. The loops 918*a* and 918*b* are optional and the bag 90 may not have the loops in other embodiments.

The bag 90 also has an optional opening 910 for an optional shoe compartment. The shoe compartment is formed inside the bag 90 by a lining sack 911. Just like the main opening on the upper side of the bag 90, the opening 910 for the shoe compartment is provided with a zipper 912. Instead of a zipper, a magnet, hook-and-loop fastener or snap button may be used. Optionally, no closure member is used. The shoe compartment may be suitable for apparel (like a jersey, a t-shirt, underwear, sports pants) or sports equipment (like a soccer ball, basketball, shin guards, rackets) as well. The bag 90 may comprise other compartments or pockets as well, which may be arranged inside or outside of the bag 90. Such compartments or pockets may be created during the knitting process as a one-piece knitwear, or may be manufactured in a separate step, and attached to the bag 90 by stitching, gluing, or welding.

The knitwear 914 of the sack-like body 91 may also comprise at least one coated area. For example, one coated area may be located at a lower side 913 of the bag 90, which comes into contact with the ground when the bag 90 is dropped off Thus, the coating 913 protects the knitwear 914 from humidity and dust. Alternatively, or additionally, at least one coating may be located on side walls of the bag 90.

The at least one coating may, for example, be thermoplastic urethane (TPU). Alternatively or additionally, a coating based on UV glue may be used. UV glue may be applied in liquid form and cures under UV light by a photochemical process. In general, other coatings may be used as well. The coated areas may additionally, or alternatively comprise a fusible yarn. Fusible yarns melt when heated above their respective melting temperatures and stiffen when cooling below their respective melting temperatures. Stiffened fusible yarns may provide water-repellency, abrasion-resistance and reinforcement to the coated area.

FIG. 9C shows the knitwear 914 of the bag 90 of the embodiments of FIGS. 9A and 9B in more detail. The knitwear 914 comprises tunnels 92 and 97, each of which comprises a first layer and a second layer, wherein the first layer at least partly overlaps the second layer, and the first layer and the second layer are integrally knitted in a one-piece knitting process. More than two integral layers may be used as well, for example three or four, to enhance the stability.

As shown in FIG. 9C, each of the tunnels 92 comprises three tunnel segments 92*a*, 92*b* and 92*c*. Another number of tunnel segments may be used as well, and, as shown in the alternative embodiments of FIG. 9D, the tunnels 92 may not be segmented at all. Each of the tunnel segments 92*a*, 92*b* and 92*c* and each of the tunnels 97 comprise trenches 915 at opposite ends of the tunnel segments and the tunnels.

Instead of tunnels 92 and 97, pockets may be used as well. In this case, the knitwear has a first and a second layer, which are integrally formed within the knitwear with a one-piece knitting process. The layers are joined (for example, by stitching, gluing, or welding) on three sides of each pocket, and one side is be left open. Handles may enter a respective pocket through the opening of the pocket, and may be fixed in the pocket by stitching, gluing or welding either to the first layer, the second layer, or both. The handles may be fixed in the tunnels in said manner. More than two integral layers may be used as well, for example, three or four, to enhance the stability.

Furthermore, the tunnels 92, 97 or pockets may contain reinforcement elements, either only at a bottom of each tunnel or pocket, or running through the entire tunnel. The handles may be fixed at an upper end of the tunnel, or may be fixed at a different location of the bag 90.

FIG. 9D shows alternative embodiments of the bag shown in FIG. 9C. In the embodiments of FIG. 9D, the tunnels 92 run from one side of the bag 90 to another side of the bag 90 without interruption. Thus, instead of tunnel segments 92*a*, 92*b* and 92*c* (as shown in FIG. 9C), a single tunnel 92 is used.

Also shown in FIGS. 9C and 9D, is a seam 916 (dashed line) of the knitwear 914, which is used when stitching the bag 60 to obtain a final three-dimensional shape of the bag 90. Side walls of the knitwear 914 shown in FIGS. 9C and 9D are folded up and the bag 90 is stitched together, either by a stitching machine or by hand along the dashed lines 916. In general, coatings and/or zippers, buttons or hook-and-loop fasteners and/or additional pockets or applications may be applied to the bag 90 before or after stitching the bag 90 together. Rectangular-shaped excess material 917 of knitwear shown in FIGS. 9C and 9D may be stitched, such that it is fixed in the final bag. Alternatively, excess material 917 may be cut or punched.

FIGS. 9C and 9D show a liquid polymer reinforcement 913, which is applied to knitwear 914 in the area of a bottom of the bag 90. This polymer reinforcement 913 may be applied as described above in the section "Polymer Coating." Alternatively, or additionally to the polymer reinforcement being applied to the bag 90, the knitwear 914 may have fusible yarns which are heated and stiffen during cooling to form a reinforced area. Alternatively, or additionally, the knitwear may be completely or partially coated with UV glue. UV glue may be applied in liquid form and cures under UV light by a photochemical process. In general, other coatings may be used as well, or the bag 90 may comprise no coating at all.

As mentioned already, the knitwear 914 may also have at least one area with a fusible yarn (for example on the bottom or on the side walls). Fusible yarns melt when heated above their respective melting temperatures and stiffen when cooling below their respective melting temperatures. Stiffened fusible yarns may provide water-repellency, abrasion-resistance and reinforcement to the knitwear at targeted areas.

FIGS. 10A, 10B, 10C and 10D show additional embodiments of a bag 100, according to the present invention. The bag 100 comprises a sack-like body 101 and shoulder straps 102*a* and 102*b*. Accordingly, the bag 100 shown in FIGS. 10A, 10B, 10C and 10D is a backpack. The sack-like body 101 comprises a knitwear 1017 being knitted in one piece. The knitwear 1017 may be knitted on a suitable machine with suitable yarns as described in detail above. The shoulder straps 102*a* and 102*b* may be knitted in one piece with the knitwear 1017 of the sack-like body 101, or may be added to the sack-like body 101 in another step. Furthermore, instead of two shoulder straps, the embodiments of FIGS. 10A, 10B, 10C and 10D may have a single shoulder strap.

The shoulder straps 102*a* and 102*b* contain length adjusting mechanisms 103*a* and 103*b* for adapting the length of the shoulder straps 102*a* and 102*b*, so that the backpack 100 may be comfortably worn by persons of different sizes. In the embodiments of FIGS. 10A, 10B, 10C and 10D, such length adjusting mechanisms are buckles 103*a* and 103*b*. Alternatively, such length adjusting mechanisms may, for example, be hook-and-loop fasteners or snap buttons. The shoulder straps 102*a* and 102*b* may also have a fixed length and comprise no length adjusting mechanisms.

Figure 10A:
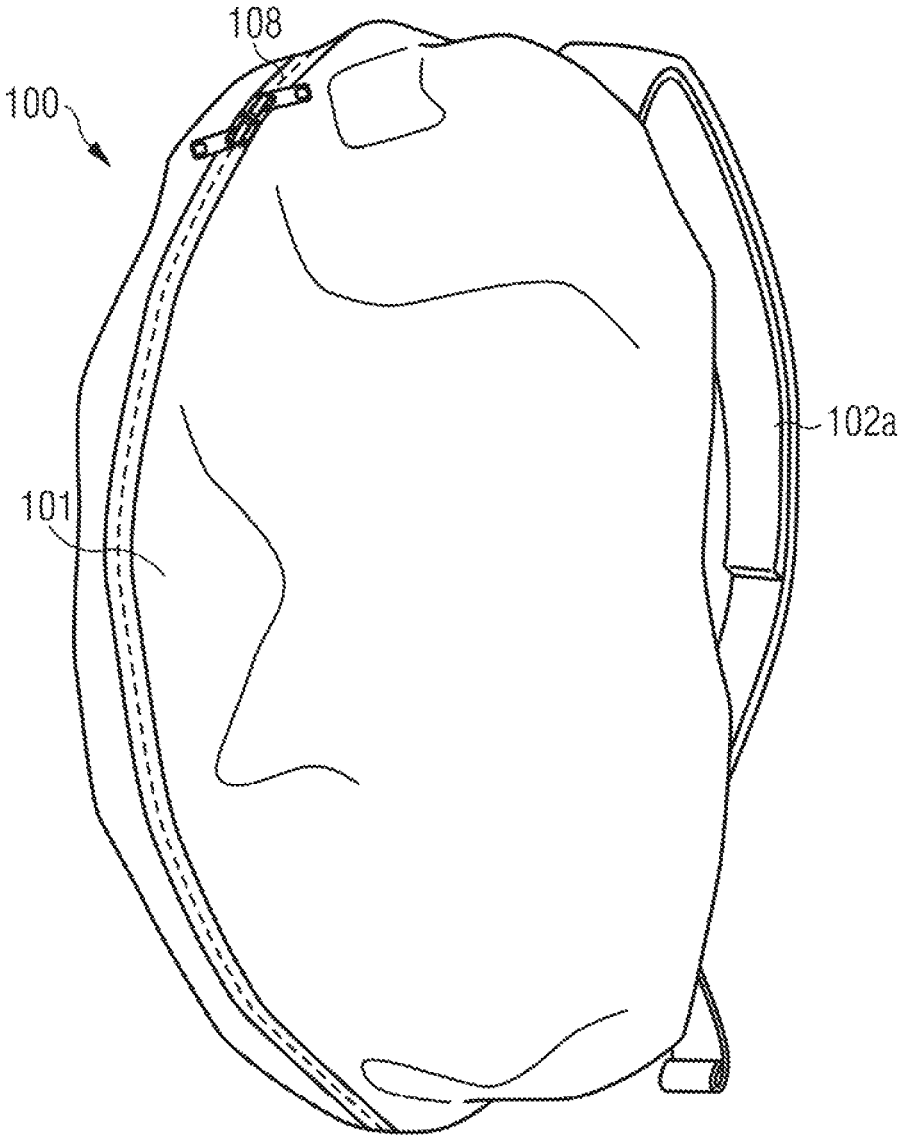
FIGS. 10A, 10B, 10C and 10D are perspective views of a bag, according to certain embodiments of the present invention.
Figure 10B:
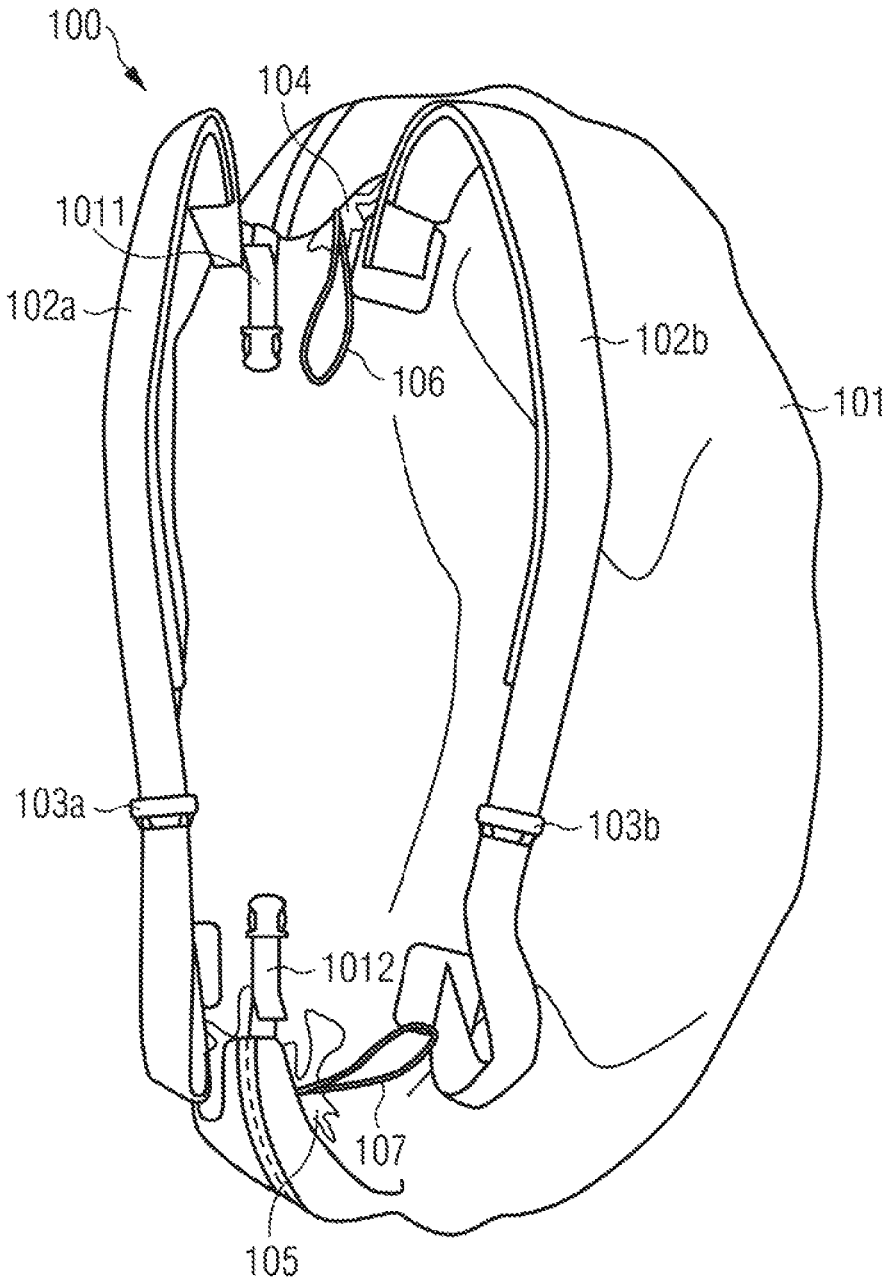

Furthermore, the sack-like body 101 comprises a first opening 104 being arranged at an upper side of the bag 100 and a second opening 105 being arranged at a lower side of the bag 100, as shown in FIG. 10B. The openings 104 and 105 may be closed by corresponding cords 106 and 107. Thus, the backpack 100 of FIGS. 10A, 10B, 10C and 10C has a tube-like topology, when the first opening 104 and the second opening 105 are each open, and a zipper 108 is closed. Instead of cords 106 and 107, other suitable closure members, such as buttons, snap buttons, zippers, or magnets may be used. The openings 104 and 105 may also comprise no closure members at all.

The sack-like body 101 comprises a zipper 108 extending from the first opening 104 to the second opening 105. As may be seen in FIG. 10D, when the zipper 108 is open, the interior of the backpack 100 is easily accessible. Instead of a zipper, other closure members may be used, such as buttons, snap buttons, or magnets.

The sack-like body 101 comprises a knitwear 1017 being knitted in one piece. In the embodiments of FIGS. 10A, 10B, 10C and 10D, the sack-like body 101 is almost entirely made from one-piece knitwear, exceptions being the cords 106 and 107 and the zipper 108. The knitwear 1017 may be manufactured on a suitable machine with suitable yarns as described in detail above.

Figure 10C:
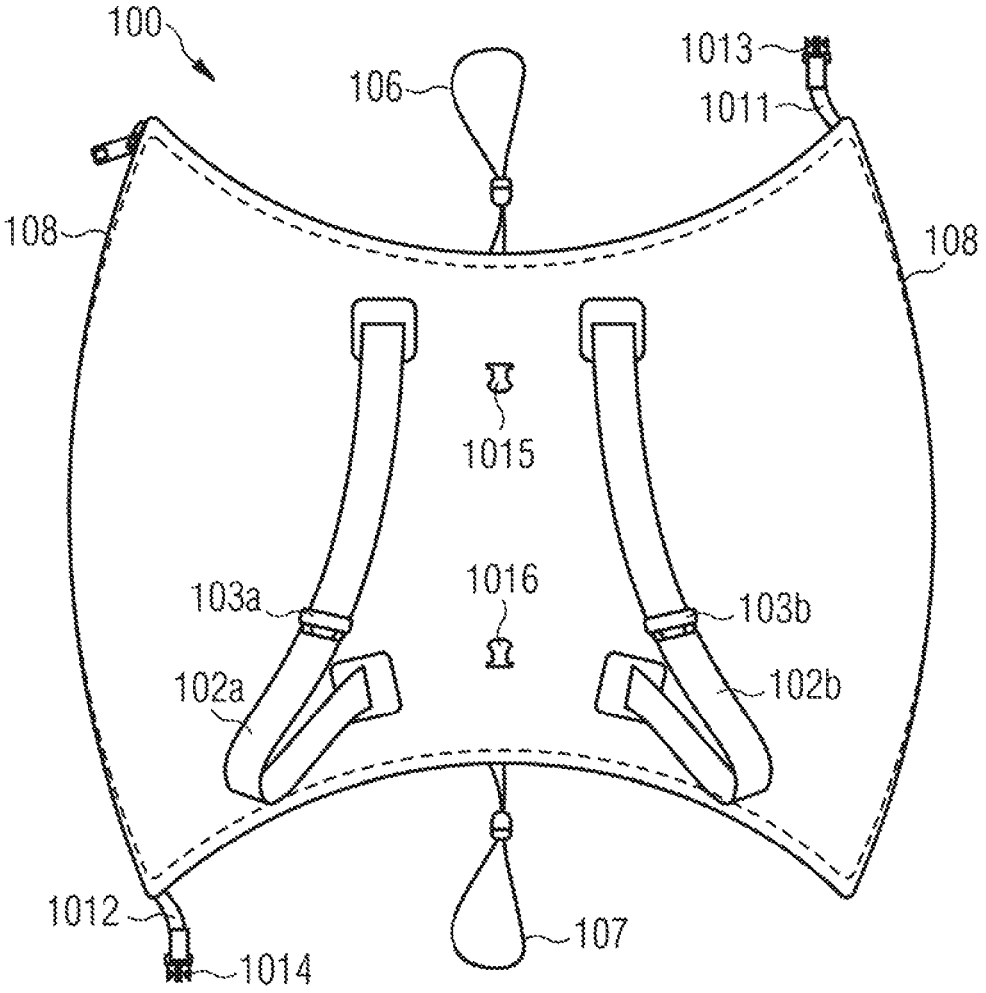
Figure 10D:
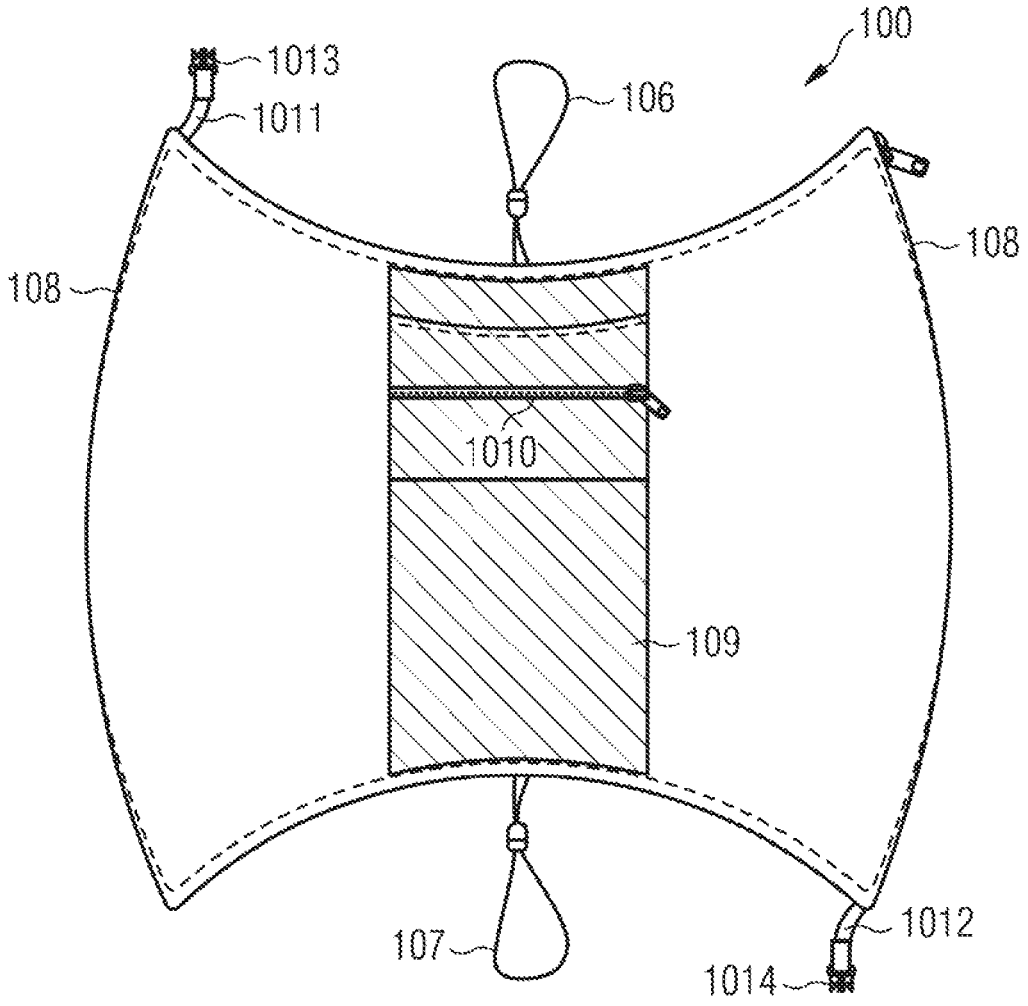

As may be seen in more detail in FIG. 10D, the knitwear 1017 comprises a first layer and a second layer, wherein the first layer at least partly overlaps the second layer, and the first layer and the second layer are knitted in a one-piece knitting process. Thus, in the embodiments of FIG. 10D, the knitwear 1017 comprises two overlapping (in fact congruent) layers in an area 109. In the remaining part of the knitwear 1017, the knitwear 1017 comprises only a single layer. More than two integral layers may be used as well, for example three or four, to enhance the stability.

In the area 109, a pocket is formed by the two overlapping layers of knitwear 1017. In FIG. 10D, the pocket is formed on the inside of the bag 100, but may also be formed on the outside of the bag 100. The pocket may, for example, be used to store items, such as a wallet, a smartphone, or a tablet PC. The bag 100 may have more than one pocket that is integrally formed as one piece with the knitwear 1017 of the bag 100. Additionally, the bag 100 may comprise pockets that are attached to the bag 100 in a separate step, for example, by gluing, welding or stitching.

In the embodiments of FIG. 10D, the pocket in the area 109 comprises a zipper 1010. Instead of a zipper, other closure members may be used a well, such as buttons, snap buttons or magnets. The pocket may also comprise no closure member at all.

A main compartment as well as every pocket of the bag 100 may optionally comprise a lining which is added in another step, either before or after the bag 100 is stitched together. The lining may be made from a textile material, such as a woven or knit, or a mesh. The lining may be glued, stitched or welded to the main compartment and/or additional pockets. Alternatively, the lining may be integrally formed in a one-piece knitting process with the knitwear 914 of the bag 100 as at least one layer of the knitwear.

The bag 100 of the embodiments of FIGS. 10A, 10B, 10C and 10D also comprises a strap 1011 on an upper side of the bag 100 and a strap 1012 on a lower side of the bag 100. The strap 1011 comprises a snap fastener 1013 and the strap 1012 comprises a snap fastener 1014. As shown in FIG. 10C, the sack-like body 101 of the bag 100 comprises corresponding counter elements 1015 and 1016 for the snap fasteners 1013 and 1014, respectively. As shown in FIG. 10B, the straps 1011 and 1012 may be fixed to the backside of the backpack 100 by the snap fasteners 1013, 1014 and the corresponding counter elements 1015, 1016, respectively. In this way, the openings 104 and 105 of the bag 100 may be further secured and may prevent items from sliding out of the bag 100 accidentally. The straps 1011 and 1012 may also be adjustable by length adjusting mechanisms such as a buckle or similar mechanisms.

Instead of snap fasteners 1013, 1014, other fixing members may be used as well, such as hook-and-loop fasteners, buttons, snap buttons, or magnets. Also, the straps 1011 and 1012 are optional. Thus, the bag may comprise only the upper strap 1011, only the lower strap 1012, or none of the straps 1011 and 1012 at all.

FIGS. 10A and 10B show the bag 100 in a closed configuration. In this configuration, items may be stored in the bag 100 and the bag 100 may be worn on the back of a person. FIGS. 10C and 10D show the bag 100 in an open configuration. In this configuration, the inside of the bag 100 is easily accessible and the bag 100 may be packed with items. The bag 100 is transformed from the open configuration shown in FIGS. 10C and 10D into the closed configuration shown in FIGS. 10A and 10B by closing the zipper 108, pulling the cords 106 and 107 and fixing the straps 1011 and 1012 to the backside of the bag 100 by the snap fasteners 1013, 1014 and corresponding counter elements 1015, 1016.

FIGS. 11A, 11B, 11C and 11D show additional embodiments of a bag 110, according to the present invention. The bag 110 shown in FIGS. 11A, 11B, 11C and 11D is a handbag. The bag 110 comprises a body 111 made from one piece of knitwear 1111. The knitwear 1111 may be knitted on a suitable machine with suitable yarns as described in detail above. Furthermore, the bag 110 comprises two handles 112*a* and 112*b* for carrying the handbag 110.

Figure 11A:
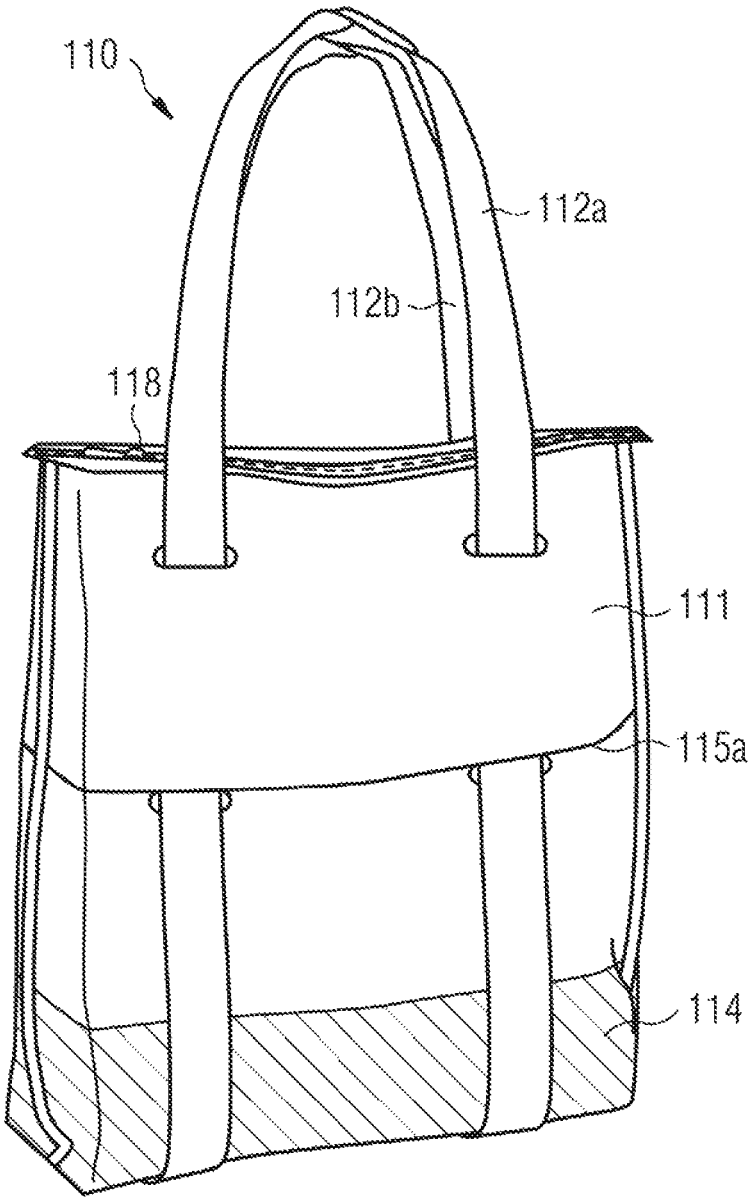
FIGS. 11A, 11B, 11C and 11D are perspective views of a bag, according to some embodiments of the present invention.
Figure 11B:
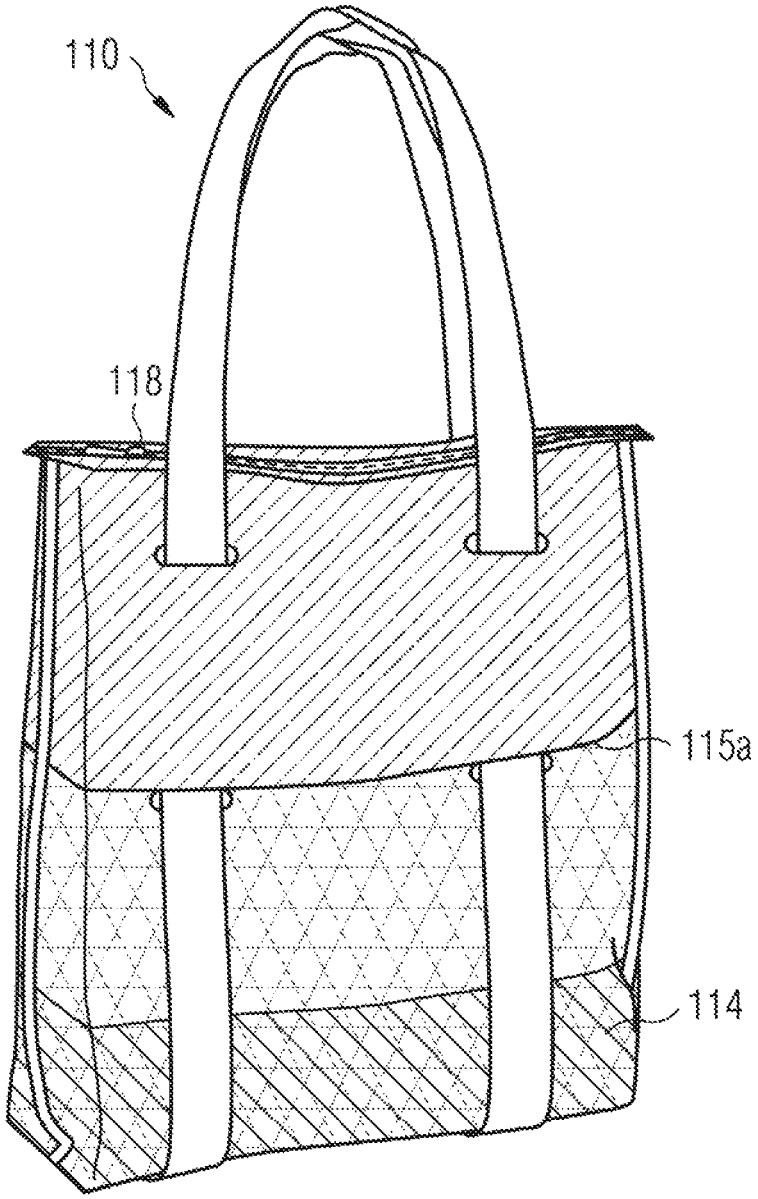
Figure 11C:
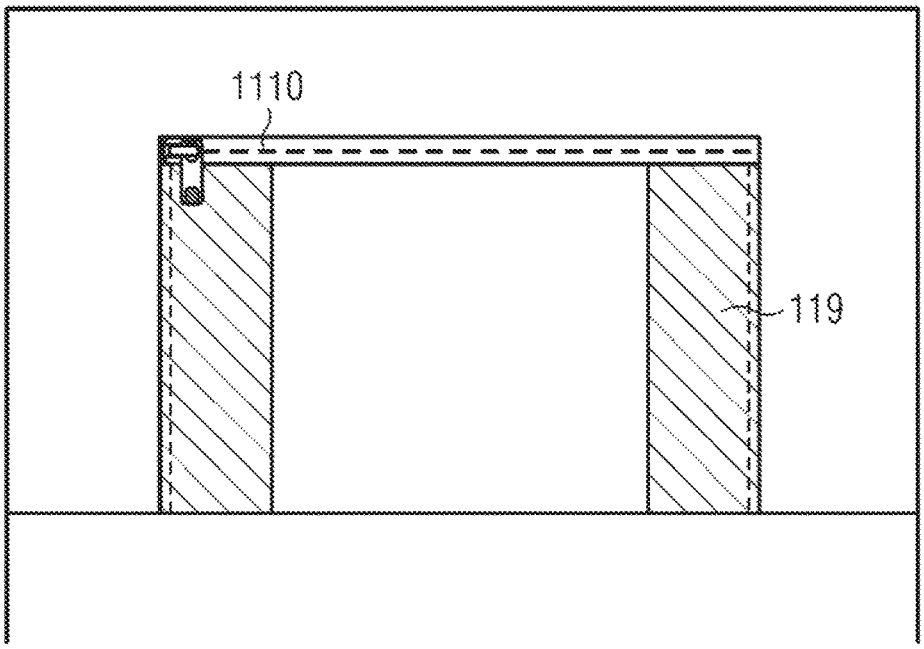
Figure 11D:
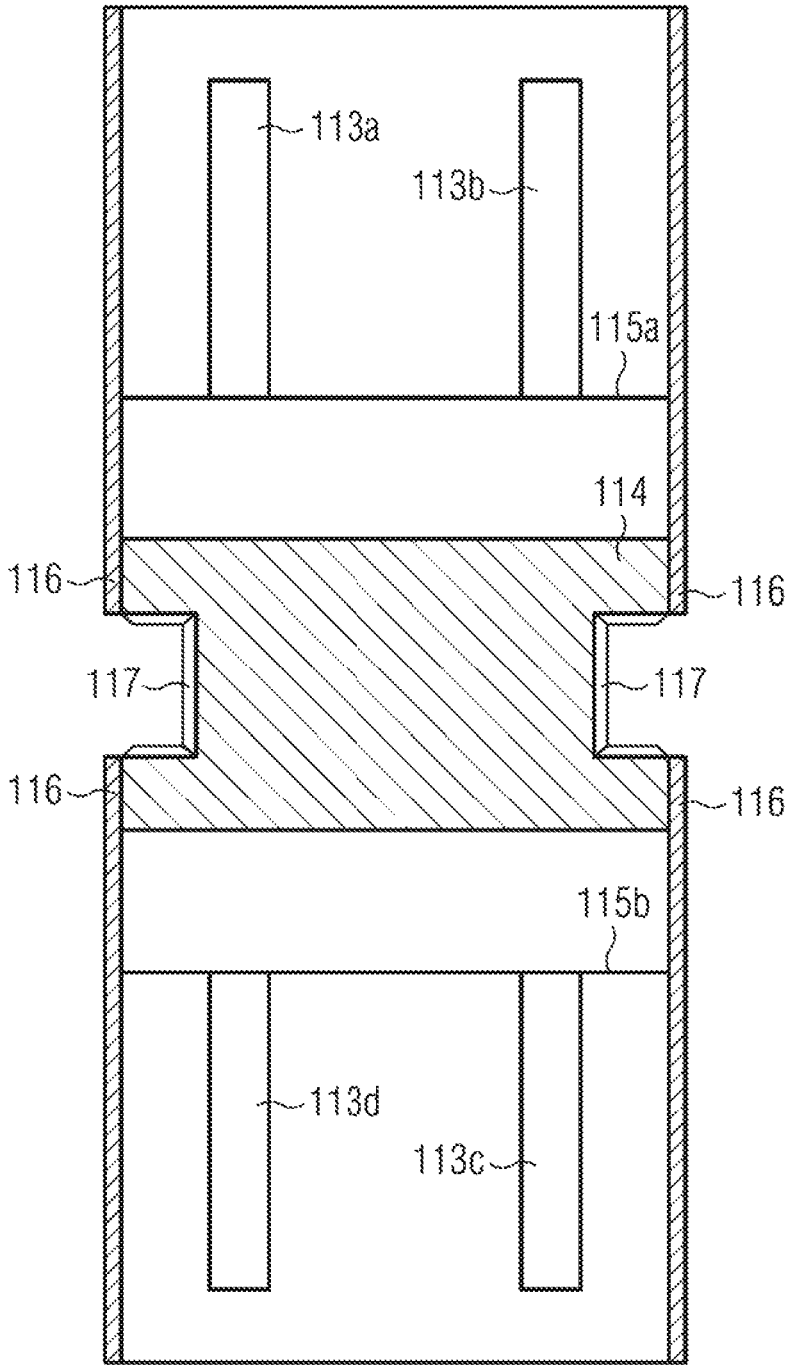

In FIG. 11D, which shows the layout of the knitwear 1111 of the bag 110, the knitwear 1111 comprises a first layer and a second layer, wherein the first layer at least partly overlaps the second layer, and the first layer and the second layer are knitted integrally in a one-piece knitting process in areas 113*a*, 113*b*, 113*c* and 113*d*. Longer sides of each of these areas are closed, whereas shorter sides of each of these areas are open. Thus, in the areas 113*a*, 113*b*, 113*c* and 113*d* tunnels are formed by the two-layered knitwear 1111. More than two integral layers may be used as well, for example, three or four, to enhance the stability.

As shown FIGS. 11A and 11B, a webbing forming the handles 112*a* and 112*b* runs through the tunnels 113*a*, 113*b*, 113*c* and 113*d*. The webbing may be a single piece of textile material. Alternatively leather, artificial leather or a similar material may be used. In FIGS. 11A, 11B, 11C and 11D, the webbing is a single, closed ring. Alternatively, two webbings in the form of straps may be used, one for each handle 112*a* and 112*b*. In this case, the webbings may be fixed to the body 111 of the bag 110, for example at a bottom of the bag 110, by stitching, gluing or welding. Also in case of the single, ring-shaped webbing of FIGS. 11A and 11B, the webbing may additionally be fixed to the body 111 of the bag 110 by stitching, gluing or welding.

The knitwear 1111 of the bag 110 also comprises a coating 114 on the bottom of the bag 110. This coating 114 may, for example, be a polymer coating as described in the section "Polymer Coating" above, such as TPU. Alternatively, or additionally the knitwear 1111 may comprise fusible yarns, which are heated and stiffen during cooling to form a reinforced area as described in detail above. Alternatively, or additionally, the knitwear 1111 may completely or partially be coated with UV glue. UV glue may be applied in liquid form and cures under UV light by a photochemical process. A coating or stiffened fusible yarns may provide water-repellency, abrasion-resistance and reinforcement to the knitwear 1111 at targeted areas. In general, other coatings may be used as well, or the bag 110 may comprise no coating at all.

The knitwear 1111 of the bag 110 may generally comprise different knit structures in different areas of the bag 110. For example, the knitwear 1111 of the bag 110 comprises two different types of knit structures as may be seen in FIG. 11B. An upper area of the knitwear 1111, above the lines 115*a* and 115*b* (shown in FIG. 11D) comprises a mesh-like knit structure with white and black yarns. Other colors may be used as well. A lower half, below the lines 115*a* and 115*b* comprises a closed knit structure with a coarse pattern of black and white (other colors may be used as well). In general, the knitwear 1111 may comprise other knit structures as well, and may comprise other arrangements of areas with different knitwear. The bag 110 may also comprise knitwear with a uniform knit structure. Also, yarns with different properties may be used for the knitwear 1111 as described above, for example reflective yarns, stiff yarns, or fusible yarns.

As shown in FIG. 11D, sides of the knitwear 1111 comprise a seam 116 with a different knit structure than the rest of the knitwear 1111. In FIG. 11D, the knit structure of the seam 116 is rib 2×2. Other knit structures may be used as well, and the knitwear 1111 may not comprise a seam with a different knit structure.

The bag 110 further comprises a zipper 118 for closing an opening to a main compartment of the bag 110. Instead of a zipper, at least one button, snap button, hook-and-loop fastener, or magnet may be used. The bag 110 may also comprise no closure member at all.

FIG. 11C shows an optional feature of the bag 110, a pocket 119 arranged on the inside of the bag 110. The pocket 119 may, for example, store items like a wallet, smartphone, or personal accessories. The pocket 119 may be knitted together with the knitwear 1111 of the bag 110 in a single process. In this case, first and second layers of the knitwear 1111 are formed during the knitting process, which form the pocket 119. Alternatively, the pocket 119 may be attached to the knitwear 1111 of the bag 110 in a separate step, for example by stitching, gluing or welding. The pocket 119 may alternatively be arranged on the outside of the pocket. Furthermore, the bag 110 may comprise more than one such additional pocket, which may be either knitted as one piece with the knitwear 1111, or may be attached to the knitwear 1111 in a separate step.

As shown in FIG. 11C, the pocket 119 comprises a zipper 1110 for closing the pocket 119. Instead of a zipper, at least on button, snap button, hook-and-loop fastener, or magnet, may be used as well. Alternatively, the pocket 119 may comprise no closure member at all.

A main compartment as well as every pocket of the bag 110 may optionally comprise a lining, which is added in a further step, either before or after the bag 110 is stitched together. The lining may be made from a textile material such as a woven or knit, or a mesh. The lining may be glued, stitched or welded to the main compartment and/or additional pockets. Alternatively, the lining may be integrally formed in a one-piece knitting process with the knitwear 1111 of the bag 110 as at least one layer of the knitwear.

The knitwear 1111 shown in FIG. 11D is assembled into the bag shown in FIGS. 11A and 11B by folding up side walls of the bag 110 and then stitching along seam 116 and along seam 117 to obtain a final three-dimensional shape of the bag 110. Handles 112*a* and 112*b* are attached. The coating 114, the zipper 118 or further optional applications (like additional pockets, logos, letterings, reinforcements) may be attached to the bag 110 either before or after the bag 110 is stitched together.

The knitwear of embodiments of the present invention may be either weft-knitted or warp-knitted. Also, features of particular embodiments of the present invention may be incorporated into other embodiments. Specifically, all embodiments and examples described in this specification may be combined with each other. For example, features of some embodiments and/or examples may be combined with features of other embodiments and/or examples, which may yield additional embodiments and/or examples, although the combination of these features is not explicitly mentioned herein.

In the following, further examples are described to facilitate the understanding of the invention:

Bag (70, 80, 90, 100, 110), comprising:

a sack-like body (71, 81, 91, 101, 111) comprising a knitwear (717, 811, 914, 1017, 1111), which is knitted in one piece, wherein the knitwear (717, 811, 914, 1017, 1111) comprises a first layer and a second layer, wherein the first layer at least partly overlaps the second layer, and wherein the first layer and the second layer are knitted integrally in a one-piece knitting process.

Bag (70, 80, 90, 100, 110) according to the preceding example, further comprising at least one handle (93, 112*a*, 112*b*).

Bag (70, 80, 90, 100, 110) according to the preceding example, wherein the handle (93, 112*a*, 112*b*) is knitted in one piece with the knitwear (717, 811, 914, 1017, 1111) of the sack-like body (71, 81, 91, 101, 111).

Bag (70, 80, 90, 100, 110) according to any one of examples 2 to 3, wherein the handle (93, 112*a*, 112*b*) comprises tubular knitwear.

Bag (70, 80, 90, 100, 110) according to any one of the preceding examples, wherein the first layer and the second layer form a tunnel (78*a*, 78*b*, 84*a*, 84*b*, 92, 97, 113*a*, 113*b*, 113*c*, 113*d*) in the knitwear (717, 811, 914, 1017, 1111) having a first opening and a second opening.

Bag (70, 80, 90, 100, 110) according to the preceding example, further comprising a reinforcing webbing arranged in the tunnel (78*a*, 78*b*, 84*a*, 84*b*, 92, 97, 113*a*, 113*b*, 113*c*, 113*d*).

Bag (70, 80, 90, 100, 110) according to any one of examples 1 to 4, wherein the first layer and the second layer form a pocket (711, 109, 119) in the knitwear, and wherein the pocket has one opening.

Bag (70, 80, 90, 100, 110) according to any one of the preceding examples, wherein a padding or a reinforcement is arranged between the first layer and the second layer.

Bag according to any one of the preceding examples, wherein the bag is a backpack (70, 80, 100).

Bag (70, 80, 100) according to example 9, wherein the backpack (70, 80, 100) comprises a first opening (104) located at an upper side of the backpack and a second opening (105) located at a lower side of the backpack, such that the backpack (70, 80, 100) has a tube-like topology, when the first opening (104) and the second opening (105) are each open.

Bag (70, 80, 100) according to example 10, wherein the backpack (70, 80, 100) comprises a closure member (108) extending from the first opening (104) to the second opening (105).

Bag (70, 80, 100) according to one of examples 9 to 11, wherein the backpack (70, 80, 100) comprises at least one shoulder strap (72*a*, 82*a*, 102*a*, 72*b*, 82*b*, 102*b*).

Bag (70, 80, 100) according to the preceding example, wherein the at least one shoulder strap (72*a*, 82*a*, 102*a*, 72*b*, 82*b*, 102*b*) is knitted in one piece with the knitwear of the sack-like body (71, 81, 101).

Bag (70, 80, 100) according to example 12, wherein the shoulder strap (72*a*, 82*a*, 102*a*, 72*b*, 82*b*, 102*b*) is manufactured separately from the sack-like body (71, 81, 101) and attached to the sack-like body (71, 81, 101).

Bag (70, 80, 100) according to any one of examples 12 to 14, wherein the at least one shoulder strap (72*a*, 82*a*, 102*a*, 72*b*, 82*b*, 102*b*) comprises tubular knitwear.

Bag (70, 80, 90, 100, 110) according to any one of the preceding examples, wherein the sack-like body (71, 81, 91, 101, 111) comprises at least one fusible yarn, which has been fused to reinforce the sack-like body (71, 81, 91, 101, 111).

Bag (70, 80, 90, 100, 110) according to any one of the preceding examples, wherein the sack-like body (71, 81, 91, 101, 111) comprises at least one area (77, 88, 913, 114) which is coated.

Bag (70, 80, 90, 100, 110) according to the preceding example, wherein the at least one area (77, 88, 913, 114) is coated with a TPU coating.

Bag (70, 80, 90, 100, 110) according to any one of the preceding examples, wherein the sack-like body (71, 81, 91, 101, 111) comprises a pocket (711, 109, 119).

Method for manufacturing a bag (70, 80, 90, 100, 110), comprising the steps of:

knitting a knitwear (717, 811, 914, 1017, 1111) in one piece, such that the knitwear (717, 811, 914, 1017, 1111) comprises a first layer and a second layer, wherein the first layer at least partly overlaps the second layer, and wherein the first layer and the second layer are knitted integrally in a one-piece knitting process; and forming a sack-like body (71, 81, 91, 101, 111) using the knitwear (717, 811, 914, 1017, 1111).

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A bag comprising:

a sack-like body comprising a knitwear formed during a knitting process, wherein the knitwear comprises a first knitted layer and a second knitted layer at least partially coextensive with the first knitted layer;

wherein the first knitted layer is formed of unitary one-piece construction with the second knitted layer during the knitting process;

wherein the second knitted layer is seamlessly knitted with the first knitted layer at opposite edges of the second knitted layer to form an overlapped configuration during the knitting process;

and wherein the knitted layers have unitary knit construction so as to be one-piece with the knitwear.

2. The bag according to claim 1, further comprising at least one handle.

3. The bag according to claim 2, wherein the handle, the first knitted layer, and the second knitted layer are formed of unitary one-piece construction during the knitting process so as to be one-piece with the knitwear.

4. The bag according claim 2, wherein the handle comprises a tubular knitwear.

5. The bag according to claim 1, wherein the first layer and the second layer form a tunnel in the knitwear, and wherein the tunnel has a first opening and a second opening.

6. The bag according to claim 5, further comprising a reinforcing webbing arranged in the tunnel.

7. The bag according to claim 1, wherein the first layer and the second layer form a pocket in the knitwear, and wherein the pocket has an opening.

8. The bag according to claim 1, wherein a padding or a reinforcement is arranged between the first layer and the second layer.

9. The bag according to claim 1, wherein the bag is a backpack.

10. The bag according to claim 9, wherein the backpack comprises a first opening located at an upper side of the backpack and a second opening located at a lower side of the backpack, such that the backpack has a tube-like topology, when the first opening and the second opening are each open.

11. The bag according to claim 10, wherein the backpack comprises a closure member extending from the first opening to the second opening.

12. The bag according to claim 9, wherein the backpack comprises at least one shoulder strap.

13. The bag according to claim 12, wherein the at least one shoulder strap is knitted in unitary one piece construction with the knitwear of the sack-like body during the knitting process so as to be one-piece with the knitwear.

14. The bag according to claim 12, wherein the at least one shoulder strap is manufactured separately from the sack-like body and attached to the sack-like body.

15. The bag according to claim 12, wherein the at least one shoulder strap comprises a tubular knitwear.

16. The bag according to claim 1, wherein the sack-like body comprises at least one fusible yarn, which has been fused to reinforce the sack-like body.

17. The bag according to claim 1, wherein the sack-like body comprises at least one area, which is coated.

18. The bag according to claim 17, wherein the at least one area is coated with a TPU coating.

19. The bag according to claim 1, wherein the sack-like body comprises a pocket.

20. A method for manufacturing a bag comprising:

knitting a knitwear comprising at least a first knitted layer and a second knitted layer during a knitting process, wherein the first knitted layer is formed of unitary one-piece construction with the second knitted layer during the knitting process and wherein the second knitted layer is seamlessly knitted with the first knitted layer at opposite edges of the second knitted layer to form an overlapped configuration during the knitting process; and forming a sack-like body using the knitwear.

21. A bag comprising:

a sack-like body, wherein at least a portion of the sack-like body is formed of a knitwear formed during a knitting process comprising a first knitted layer and a second knitted layer at least partially coextensive with the first knitted layer;

wherein the first knitted layer is formed of unitary one-piece construction with the second knitted layer during the knitting process;

wherein the second knitted layer is seamlessly knitted with the first knitted layer at opposite edges of the second knitted layer to form an overlapped configuration during the knitting process;

and wherein the knitted layers have unitary knit construction so as to be one-piece with the knitwear.

* * * * *